US005449979A

United States Patent [19]

Ueoka et al.

[11] Patent Number: 5,449,979

[45] Date of Patent: Sep. 12, 1995

[54] INVERTER POWER SUPPLY

[75] Inventors: Atsushi Ueoka, Moriguchi; Akinori Hiramatsu, Ikoma; Hiroyuki Sako; Kazuhiro Gotoh, both of Hirakata, all of Japan

[73] Assignee: Matsushita Electric Works, Ltd., Osaka, Japan

[21] Appl. No.: 125,436

[22] Filed: Sep. 22, 1993

[30] Foreign Application Priority Data

Sep. 25, 1992 [JP] Japan ..... 4-257025
Sep. 25, 1992 [JP] Japan ..... 4-257026
Sep. 25, 1992 [JP] Japan ..... 4-257027

[51] Int. Cl.[6] ..... H05B 37/02

[52] U.S. Cl. ..... 315/225; 315/224; 315/209 R; 315/219; 315/276; 315/DIG. 7

[58] Field of Search ..... 315/219, 209 R, 225, 315/276, 277, 307, 360, DIG. 2, DIG. 5, DIG. 7, DIG. 4, 223, 224, 291, 324, 127

[56] References Cited

U.S. PATENT DOCUMENTS

| | | | |
|---|---|---|---|
| 4,346,332 | 8/1982 | Walden | 315/387 |
| 4,461,980 | 7/1984 | Nilssen | 315/225 |
| 4,719,556 | 1/1988 | Wise | 363/56 |
| 5,130,610 | 7/1992 | Kakitani | 315/219 |
| 5,138,234 | 8/1992 | Moisin | 315/209 R |
| 5,294,868 | 3/1994 | Jones et al. | 315/219 X |

*Primary Examiner*—Robert J. Pascal
*Assistant Examiner*—Haissa Philogene
*Attorney, Agent, or Firm*—Kenyon & Kenyon

[57] ABSTRACT

A power supply with an inverter capable of avoiding the inverter from producing excessive high voltage when a load is detached or the load impedance is greatly increased. The inverter is energized by a fixed DC voltage source and includes at least one switching element and an L-C resonant circuit. The switching element is driven to turn on and off and cooperative with the L-C resonant circuit to produce a high frequency AC voltage at an inverter output for driving a load. The inverter includes first and second clamping diodes connected in series across the DC voltage source in anti-parallel relation thereto with the first and second diodes defining therebetween a first connection point. Also included in the inverter is a pair of first and second impedance elements which are connected in series across the inverter output to provide a divided voltage indicative of an output voltage of the inverter with the first and second impedance elements defining therebetween a second connection point. The first and second connection points are connected to each other so as to keep the points at a voltage level nearly equal to a fixed voltage of the DC voltage source, in such a manner as to limit the output voltage of the inverter below a predetermined level by allowing a clamping current to flow through the first and second diodes and impedance elements and through the DC voltage source to escape the excessive voltage developed in response to the increase in the impedance of the load.

24 Claims, 18 Drawing Sheets

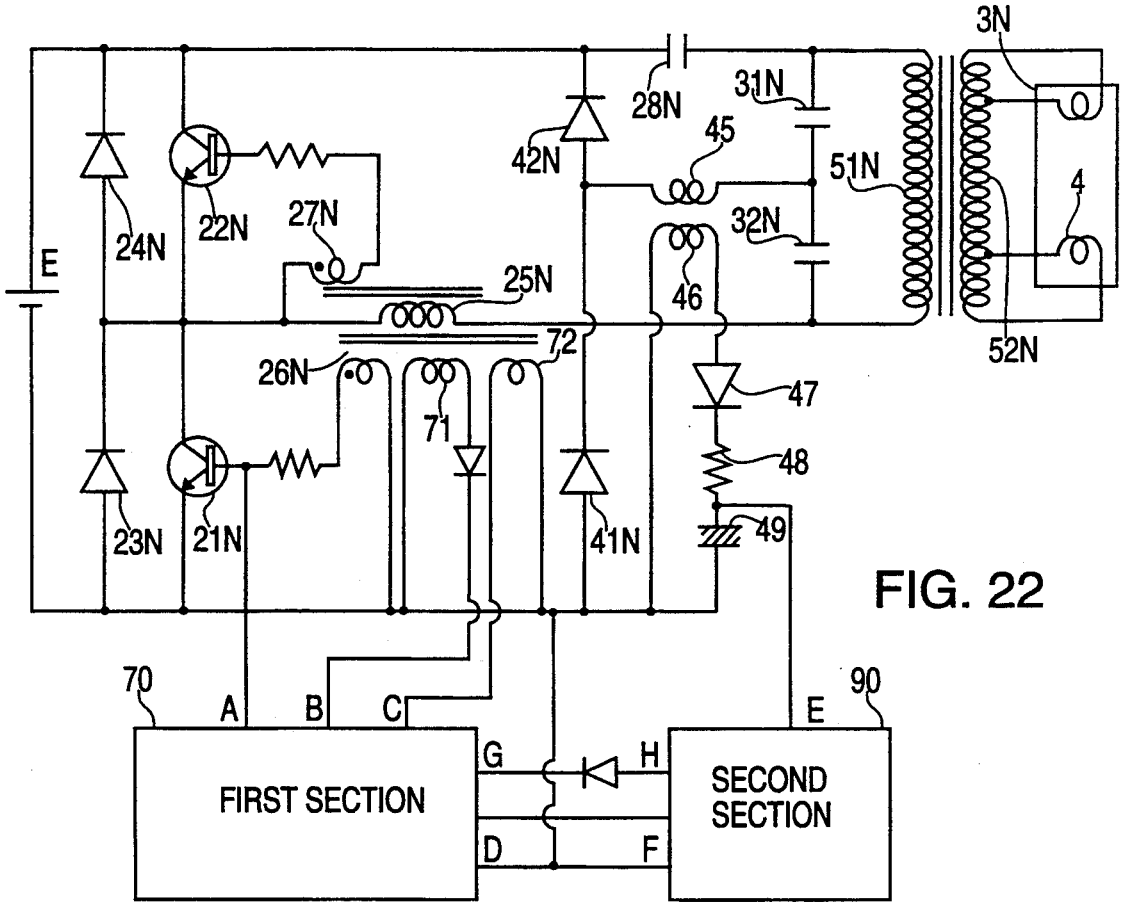
FIG. 22
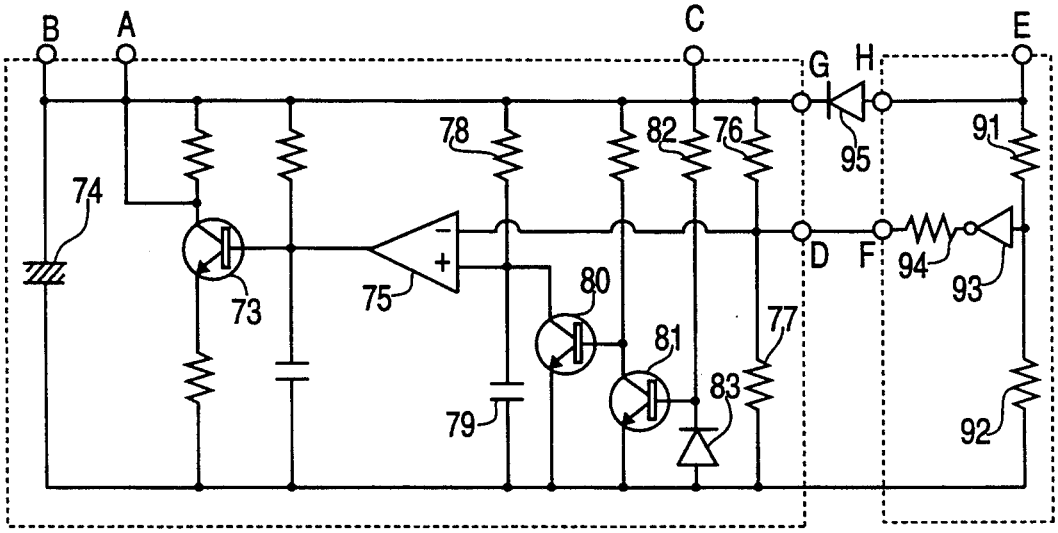

INVERTER POWER SUPPLY

BACKGROUND OF THE INVENTION

1. Field of the Invention

The present invention is directed to a power supply including an inverter to provide a high frequency AC voltage from a DC voltage source for driving a load, for example, a discharge lamp.

2. Description of the Prior Art

Power supplies with an inverter have been well known in the art as disclosed, for example, in U.S. Pat. No. 5,130,610; U.S. Pat. No. 4,461,980; U.S. Pat. No. 5,138,234; and U.S. Pat. No. 4,719,556.

U.S. Pat. No. 5,130,610 discloses a typical power supply including an inverter providing a high frequency AC voltage from a DC voltage. As shown in FIG. 1 of the attached drawings, this prior power supply has a diode-bridge rectifier DB providing from an AC voltage source AC a rectified DC voltage which is smoothed by a smoothing capacitor C0 to give a smoothed DC voltage to the inverter. The inverter INV includes a pair of transistors Q1 and Q2 which are connected in series with the smoothing capacitor C0. Connected across the first transistor Q1 is a series L-C resonant circuit composed of an inductor L1 and a capacitor C1 which are connected in series with a coupling capacitor C2. A transformer T is connected in circuit with a primary winding T1 connected across the capacitor C1 and with a secondary winding T2 connected to a load LD. The transistors Q1 and Q2 are controlled by a driver circuit to alternately turn on and off at a high frequency to cause the L-C resonant circuit to produce an oscillating voltage across the primary winding T1 to thereby apply a corresponding AC voltage to the load LD. Thus, the L-C resonant circuit provides a predetermined high frequency AC voltage to drive the load as long as the load is connected to the inverter in a good condition. However, when a load is detached to render the power supply to operate under no load condition, or when the load is deteriorated to have increased impedance as is frequently seen in the life end of the discharge lamp, the L-C resonant circuit responds to develop an excessive high voltage. With this result, the inverter sees an abnormally high resonant current flowing through the transistors to eventually destroy the transistors or at least severely damage the transistor with a considerably increased loss.

In order to eliminate the above problem, U.S. Pat. No. 4,461,980 proposed to incorporate a protection circuit which disables the inverter when the load is detached. As shown in FIG. 2 of the attached drawings, the inverter INV comprises two transistors Q1 and Q2 in half-bridge configuration with capacitors C2 and C3, and a series L-C resonant circuit composed of an inductor L1 and a capacitor C1 which are connected across the output of the half-bridge. Transistors Q1 and Q2 are coupled to a transformer T3 so as to be driven to turn on and off in a self-excited manner. A load, which is a discharge lamp, is connected across the capacitor C1. The protection circuit comprises a pair of series connected diode D3 and D4 is connected in parallel relation to the series combination of capacitor C2 and C3, and a bimetallic switch B with a heater H connected in a base-emitter path of transistor Q2. The heater H is inserted in a line connecting a tap point TP of the inductor L1 to a connection point between diodes D3 and D4. When the lamp is detached, the L-C resonant circuit responds to produce an increased voltage with an attendant increase in a voltage developed across the inductor L1, which allows a sufficient current to flow the heater H, thereby actuating the bimetallic switch B to shunt the base-emitter path of transistor Q2. In this manner, the inverter ceases operating upon detachment of the lamp, thereby preventing continued oscillation of the L-C resonant circuit and therefore well protecting the transistors from excessive high voltage which would be otherwise produced.

U.S. Pat. No. 5,138,234 discloses another prior art power supply which includes a limiter capable of avoiding excessive high voltage developed in an inverter when a load is detached therefrom. As schematically reproduced in FIG. 3 of the attached drawings, the inverter is energized by a fixed DC voltage source E and comprises a pair of transistors Q1 and Q2 arranged in a half-bridge configuration with a pair of capacitors C2 and C3. A series L-C resonant circuit composed of an inductor L1 and a capacitor C1 is connected to the bridge output so as to produce a high frequency AC voltage in response to turn on and off of transistors. An output transformer T is in circuit with a primary winding T1 connected across the capacitor C1 and with a secondary winding T2 connected to a lamp. The limiter comprises a pair of series connected clamping diode D3 and D4 which are connected across the DC voltage source E in parallel with the series combination of the capacitors C2 and C3. Connected to a point between the diodes D3 and D4 is a center tap TP of the primary winding T1 so that the connection point between diodes D3 and D4 is clamped at a fixed voltage level corresponding to the input voltage from the DC voltage source E to the inverter. With this result, if the L-C resonant circuit tends to produce an excessively high voltage upon detachment of the lamp from the inverter with an attendant voltage increase at the connection point, thus increased voltage is permitted to return through the primary winding T1, diodes D3 and D4 into capacitors C2 and C3, thereby avoiding the L-C resonant circuit from producing the excessive high voltage.

U.S. Pat. No. 4,719,556 discloses a further prior art power supply which includes a limiter for the same purpose as above. As shown in FIG. 4 of the attached drawings, the power supply comprises a like half-bridge circuit of transistors Q1 and Q2 and capacitors C2 and C3, and a series L-C resonant circuit of an inductor L1 and a capacitor C1. An output transformer T is in circuit with a primary winding T1 connected across the capacitor C1 and with a secondary winding T2 connected to a load. The limiter comprises a pair of series connected diodes D3 and D4 which is connected across a DC voltage source E in parallel relation to the series pair of capacitors C2 and C3. The diodes D3 and D4 are connected at point between the inductor L1 and the capacitor C1 in order to clamp a voltage at the connection point at a level corresponding to that of the DC voltage source E. Also with this limiter, it is possible to avoid excessive voltage from being produced at the L-C resonant circuit when the load is detached or varies its impedance by a large extent.

However, problems still remain in these prior power supplies in that the provision of the tap to the inductor or the transformer incurs rather complicated assembly with an additional manufacturing cost, as seen in the circuit of FIGS. 2 and 3, and also in that a clamping current will flow through the inductor or output transformer to raise the temperature thereof, as seen in the circuit of FIGS. 2 and 3. Further, in the circuit of FIG. 4 where the clamping diodes D3 and D4 are connected to the point between the inductor L1 and the capacitor C1 forming the L-C circuit, it is impossible to adjust a clamping voltage to which the output of the inverter is limited while assuring to produce a desired oscillation voltage at the L-C circuit. That is, the output of the inverter is limited only to a fixed clamping voltage which poses a strict limitation in the circuit design.

SUMMARY OF THE INVENTION

The above problems have been eliminated in the present invention which provides a power supply with an inverter which is capable of avoiding the inverter from producing excessive high voltage when a load is detached or the load impedance is increased by a great extent. The power supply in accordance with the present invention comprises a fixed DC voltage source by which the inverter is energized. The inverter includes at least one switching element and an L-C resonant circuit. The switching element is driven to turn on and off and cooperative with the L-C resonant circuit to produce a high frequency AC voltage at an inverter output for driving a load connected to the inverter output. The inverter includes first and second clamping diodes connected in series across the DC voltage source in anti-parallel relation thereto with the first and second diodes defining therebetween a first connection point. Also included in the inverter is a series connected pair of first and second impedance elements which are connected in circuit to provide a divided voltage indicative of an output voltage of the inverter with the first and second impedance elements defining therebetween a second connection point. The first and second connection points are connected in order to limit the output voltage of the inverter below a predetermined level. That is, the connection points are always kept at a voltage level nearly equal to a fixed voltage level of the DC voltage source. Therefore, even when the L-C resonant circuit tends to produce an excessively high voltage at the inverter output in response to the detachment of the load or the increase in the impedance of the load, the first and second impedance elements are cooperative with the first and second diodes to flow a clamping current therethrough and through the DC voltage source to avoid the excessive voltage from being developed at the inverter output, yet without flowing the clamping current through the L-C resonant circuit. Also, since the clamping current passes through one of the first and second impedance elements, it is readily possible to adjust a clamping voltage to which the inverter output is limited simply by choosing a divided ratio of the first to second impedance elements, yet without requiring to vary a normal output voltage of the inverter.

Accordingly, it is a primary object of the present invention to provide a power supply which is capable of limiting the output AC voltage to protect the switching element from being damaged by excessive current when the load is detached or the load impedance greatly increases, with a simple circuit configuration and without flowing the clamping current through the inductor of the L-C resonant circuit which would otherwise cause heat build-up in the inductor, yet with greater design flexibility.

The first and second impedance elements may be capacitors, resistors, inductors or combination thereof. When the capacitors are employed as the first and second impedance elements, these capacitors may be commonly utilized to form the L-C resonant circuit with the inductor. Further, the inverter may include an output transformer with a primary winding coupled in parallel with capacitance forming the L-C resonant circuit and with a secondary winding connected to the load. In this case, the first and second impedance elements are preferred to be connected in series across the primary winding to provide a divided voltage indicative of the output voltage of the inverter. On the other hand, the first and second impedance elements may be connected in series across the inductor forming the L-C resonant circuit to provide a like divided voltage indicative of the output voltage of the inverter.

In a preferred embodiment, the power supply additionally includes a fault detector which is enabled by the clamping current flowing through a line connected between the first and second connection points only when the L-C resonant circuit produces the excessive voltage in response to the occurrence of an abnormal condition where the load is deteriorated or detached to show an increased impedance. The fault detector includes at least one of an alarm circuit indicating the occurrence of the excessive voltage and a control circuit which controls the switching element of the inverter in the direction of lowering the output voltage of the inverter. Therefore, the excessive voltage developed at the L-C resonant circuit is best utilized to activate the fault detector for indication of the occurrent or limiting the inverter operation without requiring any additional voltage source, which is therefore another object of the present invention.

The above control circuit is particularly advantageous, for example, in a condition where a discharge lamp is deteriorated to show an increased impedance as is frequently seen in the life end of the lamp. In this condition, the control circuit acts to lower the inverter output to inform an user of the life end of the lamp, without causing inconvenience of turning off the lamp but fading the lamp, which is therefore a further object of the present invention.

In a preferred embodiment, the power supply includes a step-up chopper connected to receive a rectified DC voltage through a rectifier from an AC voltage source and develop a smoothed DC voltage across a smoothing capacitor. The chopper includes a chopper switching element which is connected in series with an inductor across the rectifier and which is driven by a chopper controller to repetitively turn on and off for providing an interrupted voltage which is smoothed by the smoothing capacitor to develop across the smoothing capacitor a step-up smoothed voltage in addition to a voltage smoothed thereat from the rectifier, thereby defining the smoothing capacitor as the above DC voltage source supplying the fixed DC voltage to the inverter. In this power supply with the chopper, a fault detector is included and is activated by the clamping current only when the L-C resonant circuit produces the excessive voltage in response to the abnormal condition. The fault detector is connected to the chopper controller in order to cease turning on and off the chopper switching element in response to the abnormal condition, thereby lowering the DC voltage supplied to the inverter and therefore the inverter output, while keeping the load energized by the lowered voltage for the same purpose as discussed in the above, which is therefore a still further object of the present invention.

In a still further embodiment in which the load is a discharge lamp with a pair of cathodes, the inverter is configured to additionally include a transformer with a primary winding and a pair of secondary windings. The primary winding is inserted in a line connected between the first and second connection points to induce voltages respectively across said secondary windings only when the L-C resonant circuit produces the excessive voltage to flow the clamping current through the line. The secondary windings are respectively connected to heat the cathodes of the lamp by the voltages inducted at the secondary windings. In this manner, at the start of the lighting the discharge lamp where the lamp shows a high impedance so as to cause the clamping current, the clamping current is best utilized to heat the cathodes for facilitating to start the lamp, which is therefore a still further object of the present invention.

In a more embodiment of the present invention in which a discharge lamp is connected as the load, the power supply may includes a timer and a switch inserted in the line connected between the first and second connection points. The timer is connected to open the switch only for a predetermined time interval after a start-up time of preheating the cathodes of the lamp, thereby disabling the operation of limiting the output voltage of the inverter only for the time interval so as to allow the excessive voltage to be applied as an ignition voltage to the discharge lamp. With this arrangement, it is possible to apply the high ignition voltage to the discharge lamp for facilitating to start the lamp, yet assuring to avoid excessive voltage applied to the lamp once the lamp is ignited, which is therefore a more object of the present invention.

These and still other objects and advantageous features will become more apparent from the following detailed description of the preferred embodiments when taken in conjunction with the attached drawings.

BRIEF DESCRIPTION OF THE DRAWINGS

FIG. 22 is a circuit diagram of a power supply in accordance with a seventh embodiment of the present invention;

DETAILED DESCRIPTION OF THE PREFERRED EMBODIMENTS

Figure 1:
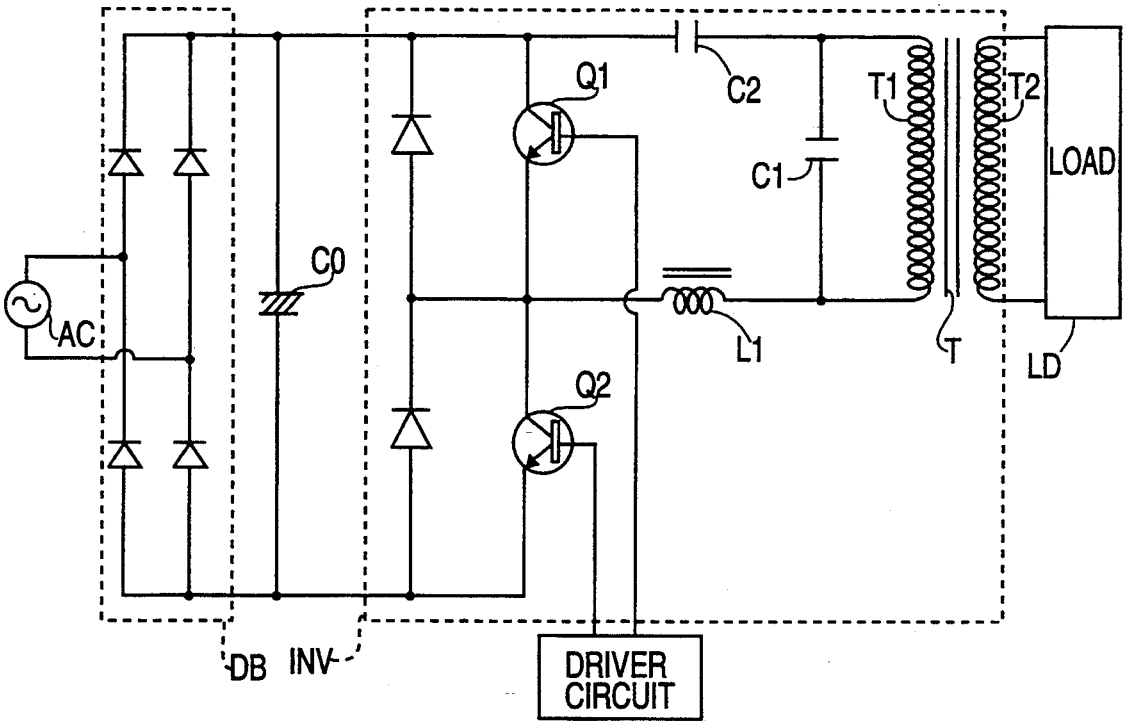
FIG. 1 (PRIOR ART)
FIGS. 1 to 4 are circuit diagrams illustrating prior art power supplies.
Figure 2:
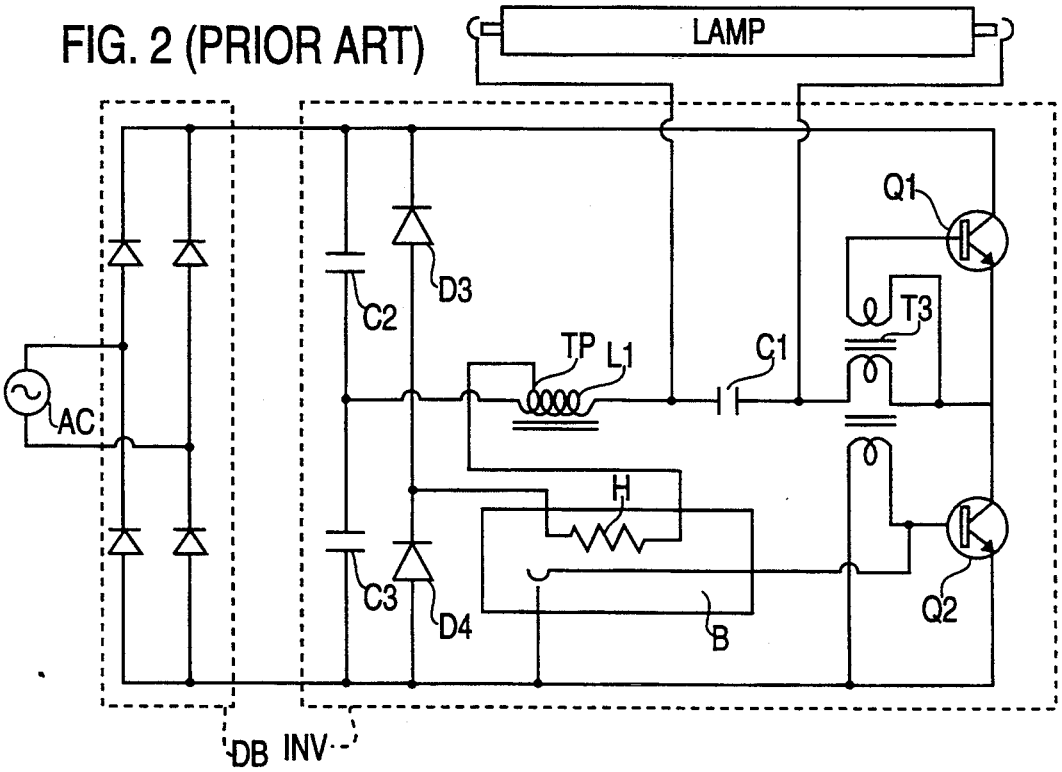
FIG. 2 (PRIOR ART)
Figure 3:
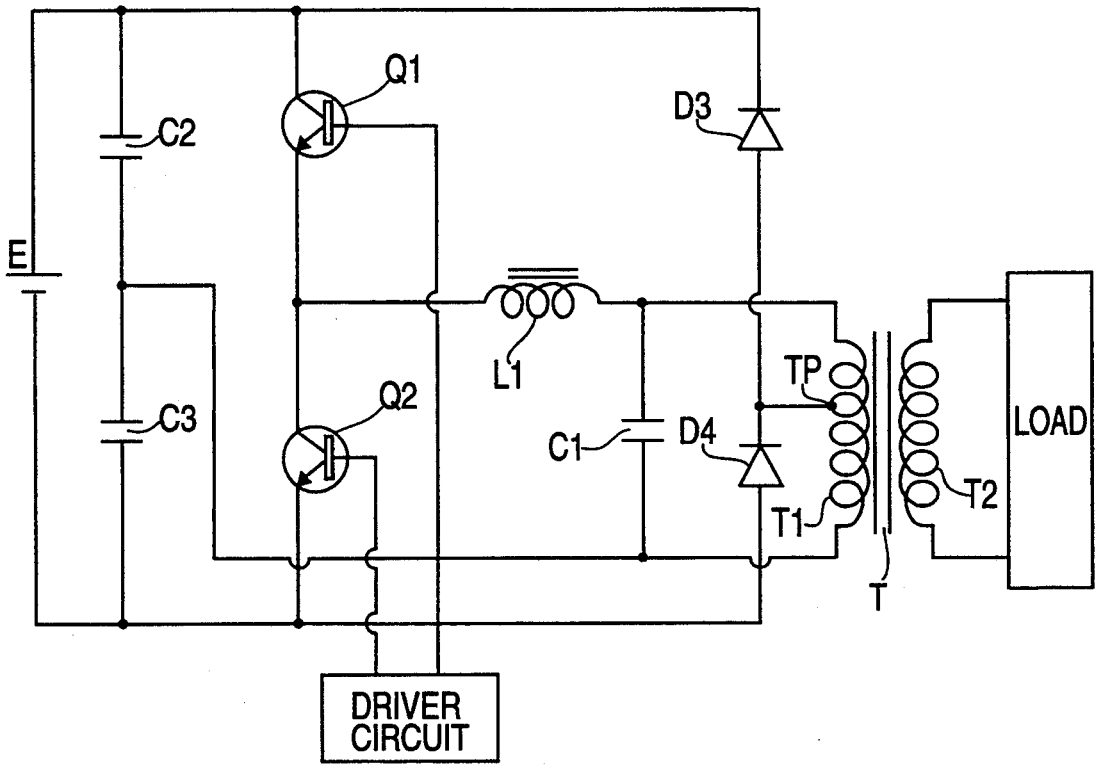
FIG. 3 (PRIOR ART)
Figure 4:
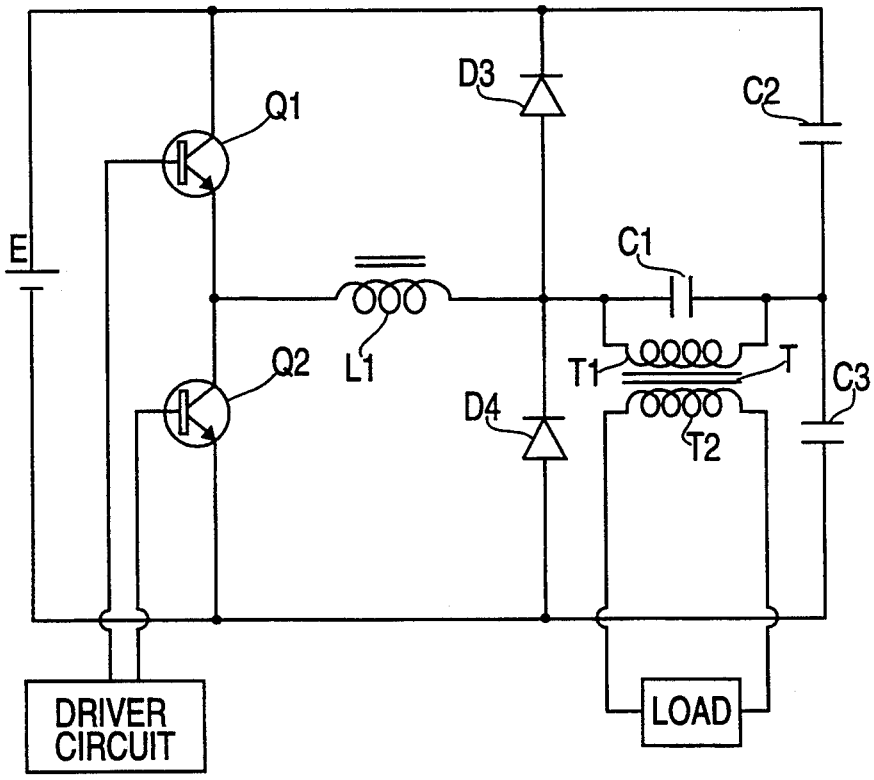
FIG. 4 (PRIOR ART)
Figure 5:
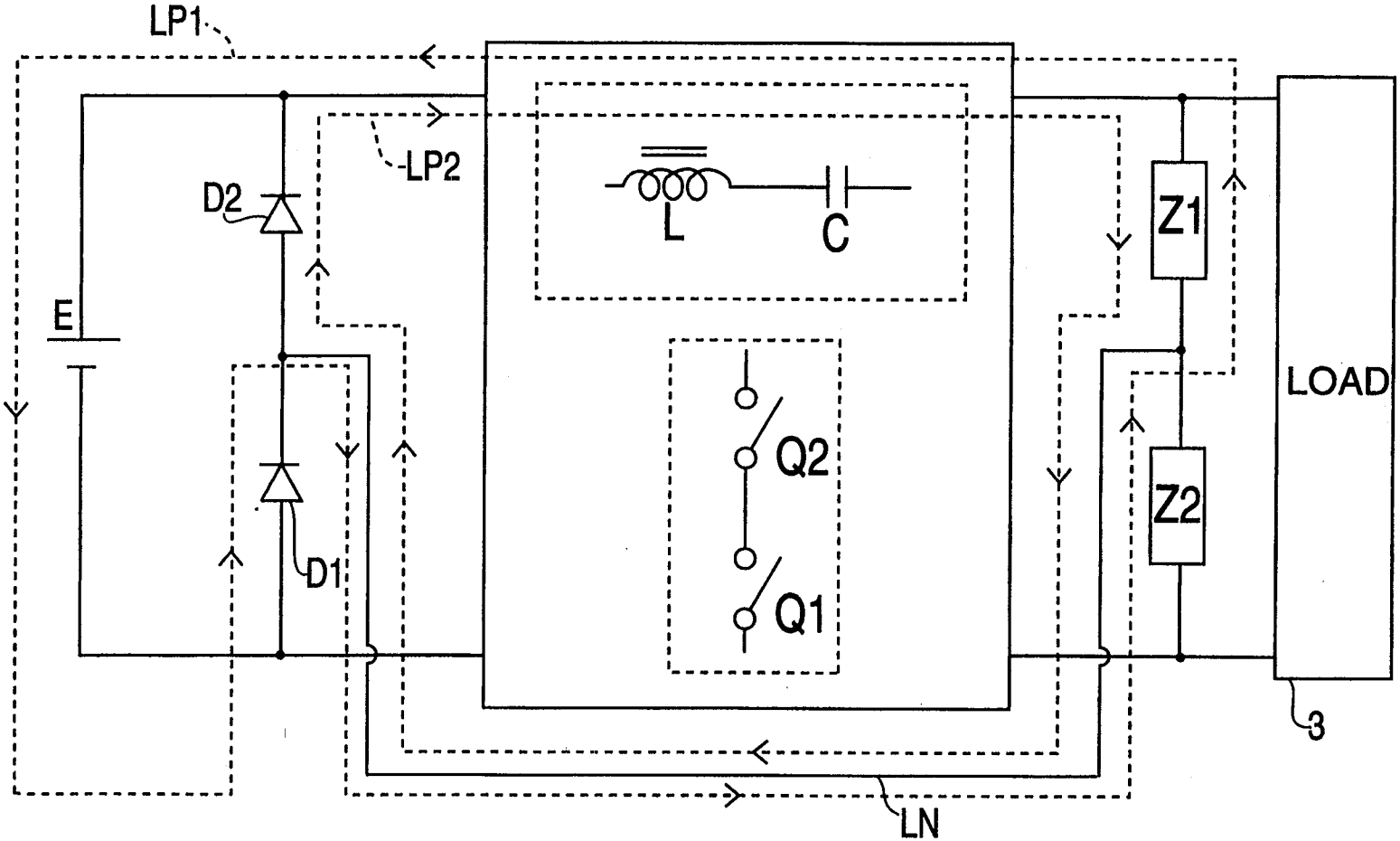
FIG. 5 is a schematic view illustrating a power supply in accordance with a first embodiment of the present invention.
Figure 6:
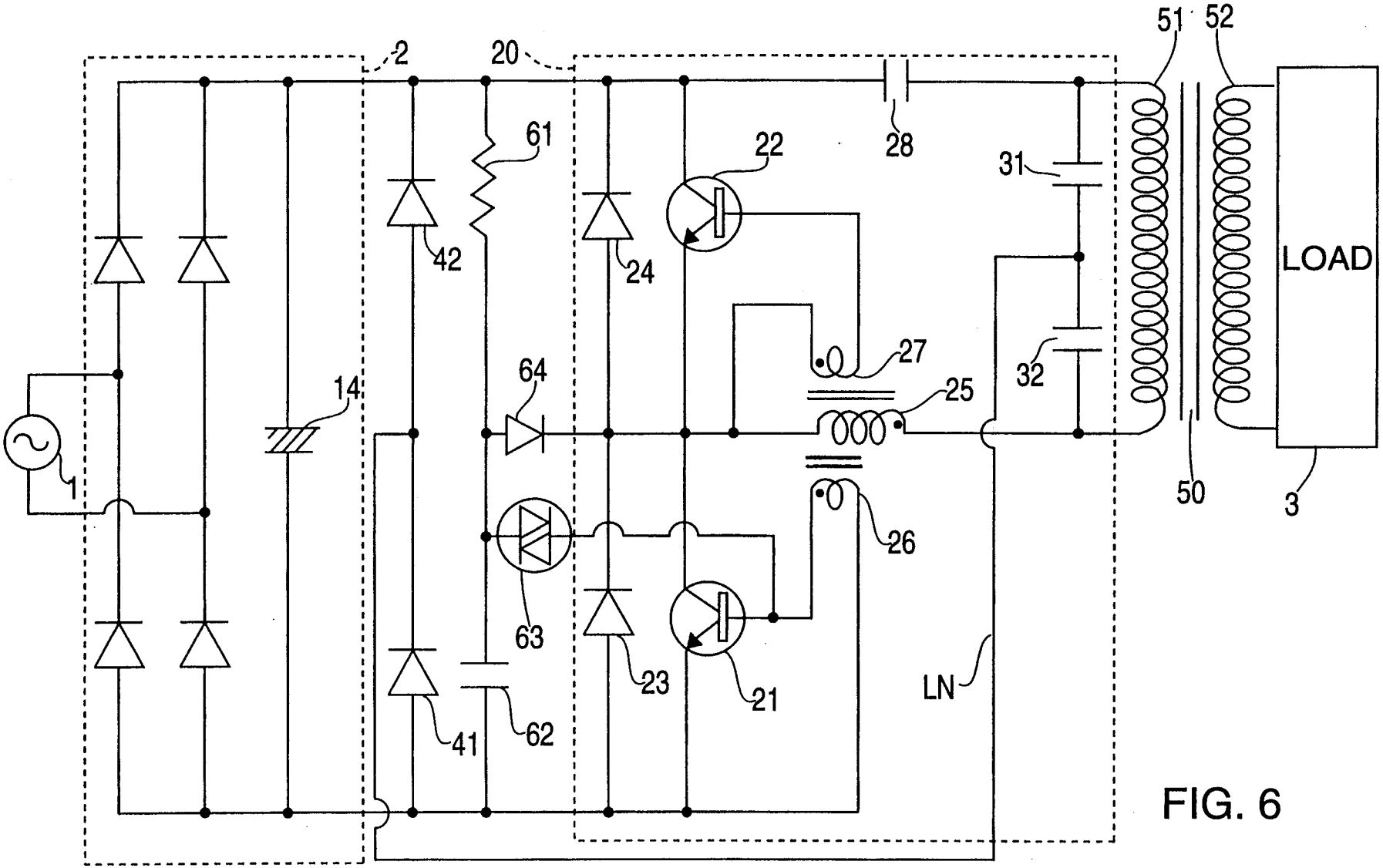
FIG. 6 is a circuit diagram of the power supply of FIG. 5.

First Embodiment <FIGS. 5 and 6>

Referring now to FIG. 5 which illustrates a schematic diagram of a power supply in accordance with a first embodiment of the present invention, the power supply comprises an inverter 20 energized by a fixed DC voltage source E. The inverter 20 includes switching transistors Q1 and Q2 and a series L-C resonant circuit which is composed of a resonant inductor L and a resonant capacitor C to provide a high frequency AC voltage to a load 3 by the switching operation of transistors Q1 and Q2. Included in the power supply is a pair of impedance elements Z1 and Z2 which are connected in series across the load 3 or an inverter output to provide a divided voltage indicative of an output voltage of the inverter, i.e., a voltage produced at the L-C resonant circuit. The impedance elements Z1 and Z2 defines therebetween a first connection point. Also included is a pair of clamping diodes D1 and D2 which are connected in series across the DC voltage source E in an anti-parallel relation thereto. The clamping diodes D1 and D2 defines therebetween a second connection point. The first and second connection points are connected through a line LN so that, when the L-C resonant circuit responds to produce an excessively high voltage upon the load 3 being disconnected or rendered to increase its impedance, a clamping current will flow selectively through a first loop LP1 of the first impedance element Z1, DC voltage source E, the first diode D1, and the line LN, and through a second loop LP2 of the first impedance element Z1, the line LN, and the second diode D2, in the directions respectively indicated by arrows in the figure, thereby limiting the output voltage of the inverter below a certain level which is determined by a divided ratio of the inverter output by the impedance elements Z1 and Z2.

FIG. 6 illustrates a concrete circuit diagram of the power supply of the first embodiment. The power supply includes a full-wave rectifier 2 in the form of a diode bridge connected to an AC mains 1 to provide a rectified DC voltage which is smoothed by a smoothing capacitor 14 so as to provide a fixed DC voltage. In this sense, the smoothing capacitor 14 defines the DC voltage source for the inverter 20. The inverter 20 comprises a pair of first and second transistors 21 and 22 (Q1 and Q2) and the series L-C resonant circuit composed of an inductor 25, and capacitors 31 and 32. The first and second transistors 21 and 22 are shunted respectively in anti-parallel relation by first and second diodes 23 and 24. An output transformer 50 is included in circuit with its primary winding 51 connected across the series combination of capacitors 31 and 32 and with its secondary winding 52 connected to the load 3. The primary winding 51 is connected in series with a coupling capacitor 28 across the second transistor 22 and defines an inverter output at which the L-C resonant circuit produces the high frequency AC voltage in response to the switching operation of transistors 21 and 22. The resulting high AC voltage is applied through the secondary winding 52 to drive the load 3. The coupling capacitor 28 is selected to have a capacitance sufficiently greater than that of capacitors 31 and 32 and is charged up to a voltage nearly half of DC voltage at the smoothing capacitor 14. The inductor 25 is magnetically coupled to first and second feedback windings 26 and 27 which are respectively connected to bases of transistors 21 and 22 for self-excitation thereof, the details of which will be discussed hereinafter.

A starter is included in circuit to comprise a series combination of a resistor 61 and a capacitor 62 connected across the smoothing capacitor 14, and a diac 63 connected to apply a starting bias to the first transistor 21 from capacitor 62 to firstly turn on the first transistor 21 when capacitor 62 is charged up to a certain level. A diode 64 is connected in series with transistor 21 in a shunting relation with capacitor 62 for discharging the voltage at capacitor 62 each time transistor 21 is turned on to thereby disable the starting bias once after the inverter starts.

The capacitors 31 and 32 forming the L-C resonant circuit with the inductor 25 are utilized in this embodiment to define therebetween the first connection point and to operates to give a divided voltage at the first connection point indicative of the output voltage of the inverter. A pair of first and second clamping diodes 41 and 42 are connected in series across smoothing capacitor 14 and define the second connection point between diodes 41 and 42. The first and second connection points are connected through the line LN so as to be of the same electrical potential in order to limit the output voltage of the inverter 20 when there arises such a great impedance increase at the inverter output as to render the L-C resonant circuit to produce the excessively high voltage.

Prior to discussing the above limiting operation, the self-excited inverter operation is now discussed with reference to FIGS. 7A to 7D and 8 under a normal condition in which the load 3 is connected to the inverter 20 with a suitable load impedance at the inverter output. In this condition, the connection points are kept at a level below the voltage level of the smoothing capacitor 14, so that both of clamping diodes 41 and 42 are kept non-conductive in the following inverter operation.

Figure 7C:
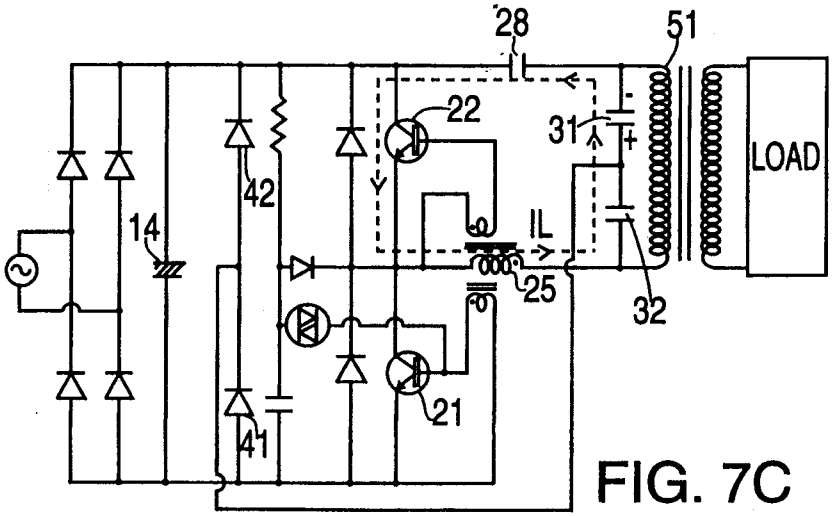
FIGS. 7A to 7D are diagram illustrating the current flowing through the circuit of the power supply of FIG. 6.
Figure 7D:
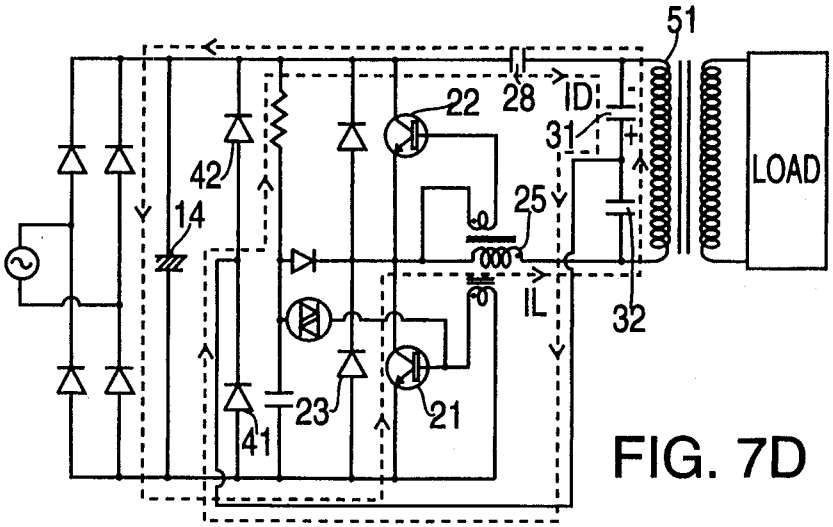
Figure 7A:
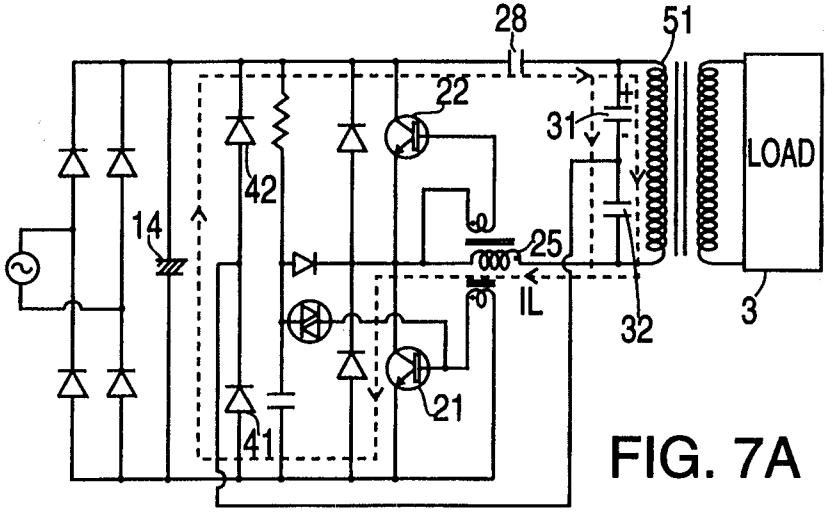

1) When the starting bias is applied to turn on the first transistor 21, the inverter 20 starts operating to flow a current IL, as shown in FIG. 7A, from smoothing capacitor 14 through coupling capacitor 28, a parallel combination of primary winding 51 and capacitors 31 and 32, inductor 25, and first transistor 21, while charging coupling capacitor 28.

Figure 7B:
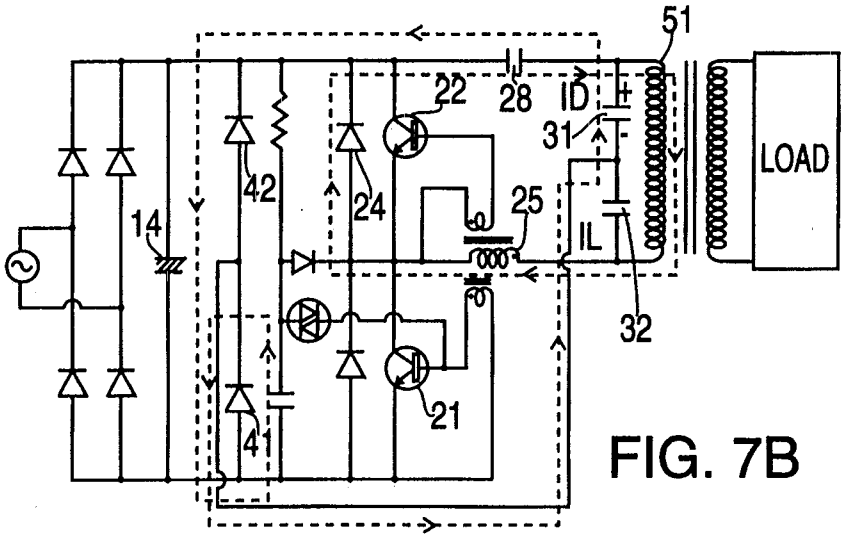
Figure 8:
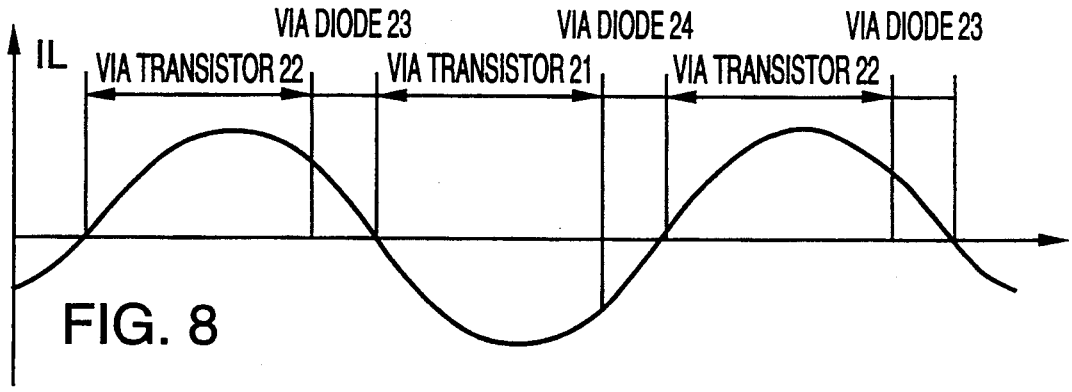
FIGS. 8 and 9A to 9C are waveform charts illustrating the operation of the power supply of FIG. 6.

2) When the current IL flows to a point where it induces no further expanding magnetic field around inductor 25, the voltage developed across first feedback winding 26 is reduced to thereby turn off first transistor 21, after which the inductor 25 continues to flow a current IL, as shown in FIG. 7B, in the same direction through the second diode 24 instead of transistor 21, capacitor 28, and the parallel combination of primary winding 51 and capacitors 31 and 32, with attendant collapsing magnetic field.

3) In response to the collapsing magnetic filed, the second feedback winding 27 induces a forward bias to turn on second transistor 22. Upon this occurrence, second transistor 22 becomes conductive to flow the current IL in the opposite direction, as shown in FIG. 7C, from capacitor 28 through second transistor 22, inductor 25, and the parallel combination of primary winding 51 and capacitors 31 and 32, and back to capacitor 28.

4) When the current IL flows to a point where it induces no further expanding magnetic field around inductor 25, the voltage developed across the second feedback winding 27 is reduced to turn off second transistor 22. Immediately thereafter inductor 25 acts also to continue flowing the current IL, as shown in FIG. 7D, through the parallel combination of primary winding 51 and capacitors 31 and 32, capacitor 28, smoothing capacitor 14, and through the first diode 23.

In this manner, the above steps are repeated so that the resonance circuit can provide an oscillating current flowing in the opposite directions with an on-time duration determined by a circuit constant of the resonance circuit.

On the other hand, when the load 3 is detached or the load impedance increases to a such a level that the L-C resonant circuit responds to produce the excessively high voltage, a clamping current will flow through the line LN and selectively through one of the clamping diodes 41 and 42 to limit the output voltage of the inverter depending upon the polarity of the output AC voltage in the manner as is now discussed with reference to FIGS. 7A to 7D and 9A to 9C.

1) Firstly, when the first transistor 21 is turned on, the current IL flows through the circuit, as shown in FIG. 7A to charge capacitor 31 with a polarity as indicated in the figure.

Figure 9A:
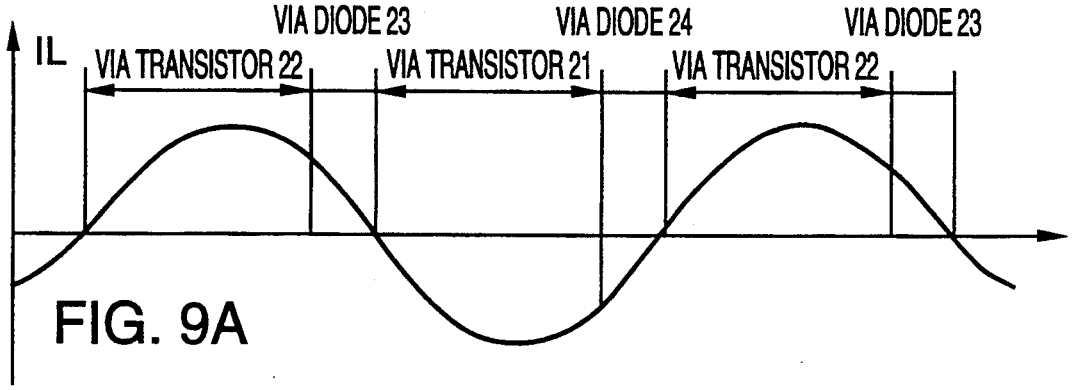
Figure 9B:
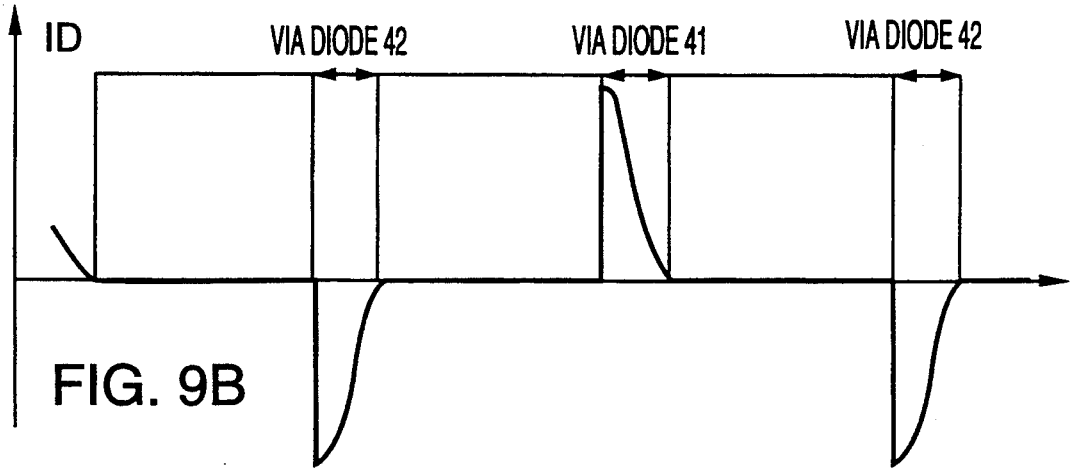
Figure 9C:
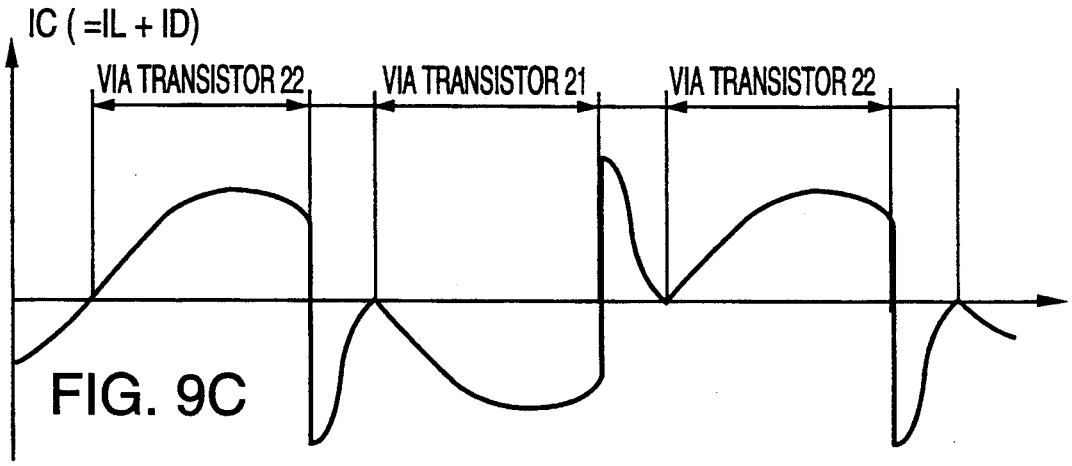

2) Subsequently, the L-C resonant circuit responds to produce the excessive voltage across the primary winding 51 such that there is developed across capacitor 31 a correspondingly large potential difference which is greater than the DC voltage of the smoothing capacitor 14 plus the forward bias of the first clamping diode 41. Whereby, the first diode 41 is made conductive to permit a clamping current ID to flow through a first loop of capacitor 31, coupling capacitor 28, smoothing capacitor 14, diode 41, and line LN in this order, as shown in FIG. 7B, and in the opposite direction to the current IL. At this occurrence, transistor 21 is turned off by the effect of the first feedback winding 26, after which the inductor 25 acts to continue flowing the current IL through diode 24, capacitor 28, primary winding 51, and back to inductor 25. Thus, a composite current Ic (IL +ID) will flow through capacitor 31, as shown in FIGS. 9A to 9C. Consequently, the voltage resulting from the clamping current ID opposes and counteracts against the voltage due to the current IL so as to limit the output voltage below a predetermined level for protecting the transistors 21 and 22 from unduly high current which would otherwise result in the absence of the clamping current, yet without flowing the clamping current ID through the inductor 25 as well as the primary winding 51.

3) Thereafter, the second transistor 22 is turned on to flow the current IL flows through the circuit in the opposite direction, as shown in FIG. 7C, to charge capacitor 31 with the opposite polarity.

4) Subsequently, the L-C resonant circuit responds to produce the excessive voltage across the primary winding 51 such that there is also developed across capacitor 31 a correspondingly large potential difference which is greater than the DC voltage of the smoothing capacitor 14 plus the forward bias of the second clamping diode 42. Whereby the second diode 42 becomes conductive to permit another clamping current ID to flow through a second loop of coupling capacitor 28, capacitor 31, line LN, and diode 42 in this order, as shown in FIG. 7D, and in the opposite direction to the current IL. At this occurrence, transistor 22 is turned off by the effect of the second feedback winding 27, after which the inductor 25 acts to continue flowing the current IL through primary winding 51, coupling capacitor 28, smoothing capacitor 14, diode 23, and back to inductor 25.

Thus, a like composite current Ic (IL+ID) will flow through capacitor 31, as shown in FIGS. 9A to 9C. Also upon this occurrence, the voltage resulting from the clamping current ID opposes and counteracts against the voltage due to the current IL so as to limit the output voltage below the predetermined level for protecting the transistors 21 and 22 from unduly high current which would otherwise result in the absence of the clamping current, yet without flowing the clamping current ID through the inductor 25 as well as the primary winding 51.

The capacitors 31 and 32 may be selected to have suitable capacitances different from each other in order to give a desired output voltage of the transformer 50.

Figure 10:
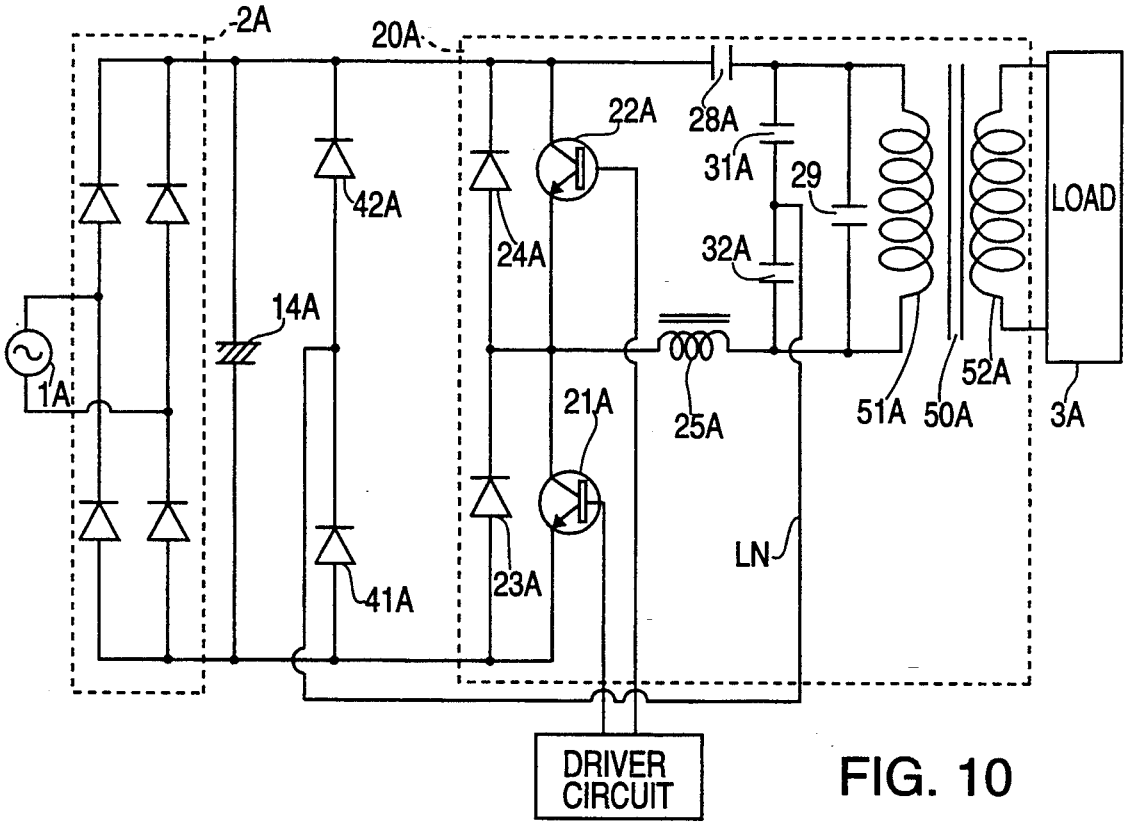
FIG. 10 is a circuit diagram of a power supply in accordance with a second embodiment of the present invention.

Second Embodiment <FIG. 10>

FIG. 10 illustrates a power supply in accordance with a second embodiment of the present invention which is similar to the first embodiment except that an additional capacitor 29 is connected across the primary winding 51A in parallel with the series combination of capacitors 31A and 32A and forms the series L-C resonant circuit with the inductor 25A, and that transistors 21A and 22A are controlled by a driver circuit to alternately turn on and off. Like elements are designated by like numerals with a suffix letter of "A". The operation is identical to the first embodiment and therefore no duplicate explanation is made herein. Transistors 21A and 21B may be self-excited as in the first embodiment.

Figure 11:
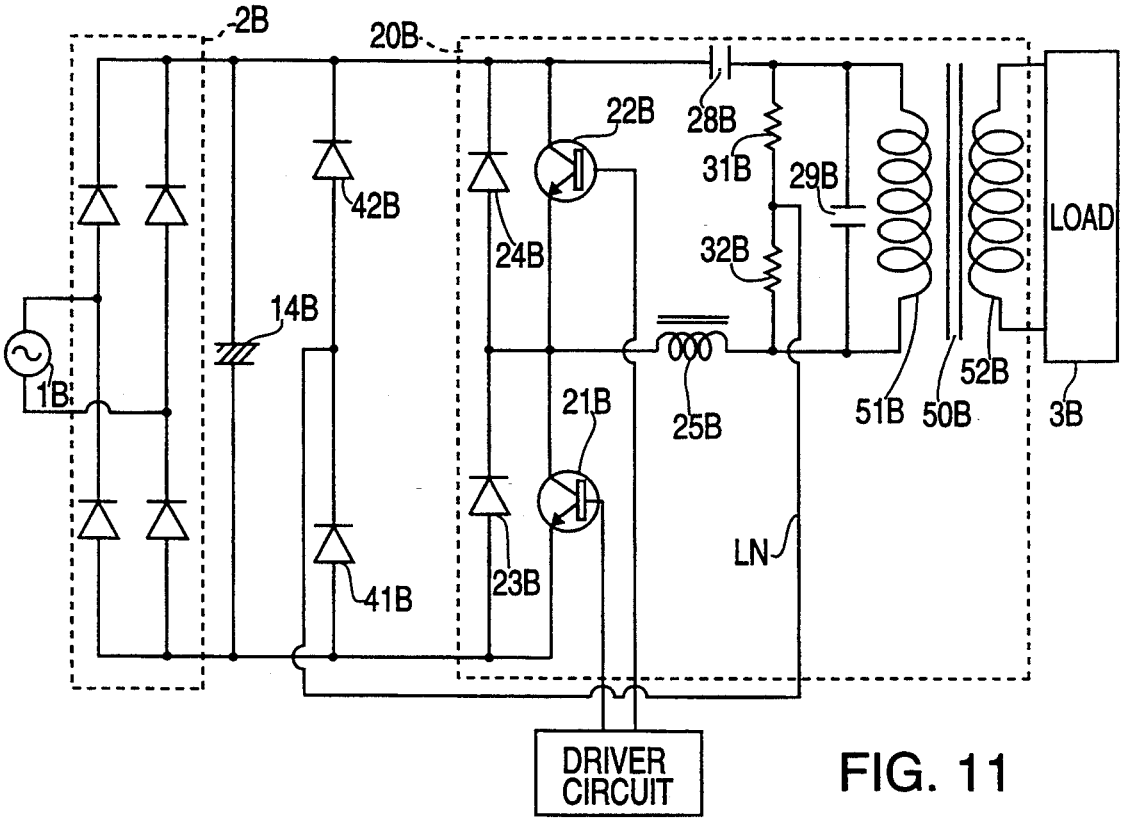
FIGS. 11 to 13 are circuit diagrams illustrating first, second, and third modifications of the power supply of FIG. 10, respectively.

FIG. 11 illustrates a first modification of the second embodiment which is identical to the second embodiment except that a series connected pair of resistors 31B and 32B is connected across the primary winding 51B as the impedance elements, instead of the capacitors 31A and 32A, to give a divided voltage indicative of the output voltage of the inverter 20B. The operation is identical to that of the first embodiment and therefore no duplicate explanation is made herein. Like elements are designated by like numerals with a suffix letter of "B".

Figure 12:
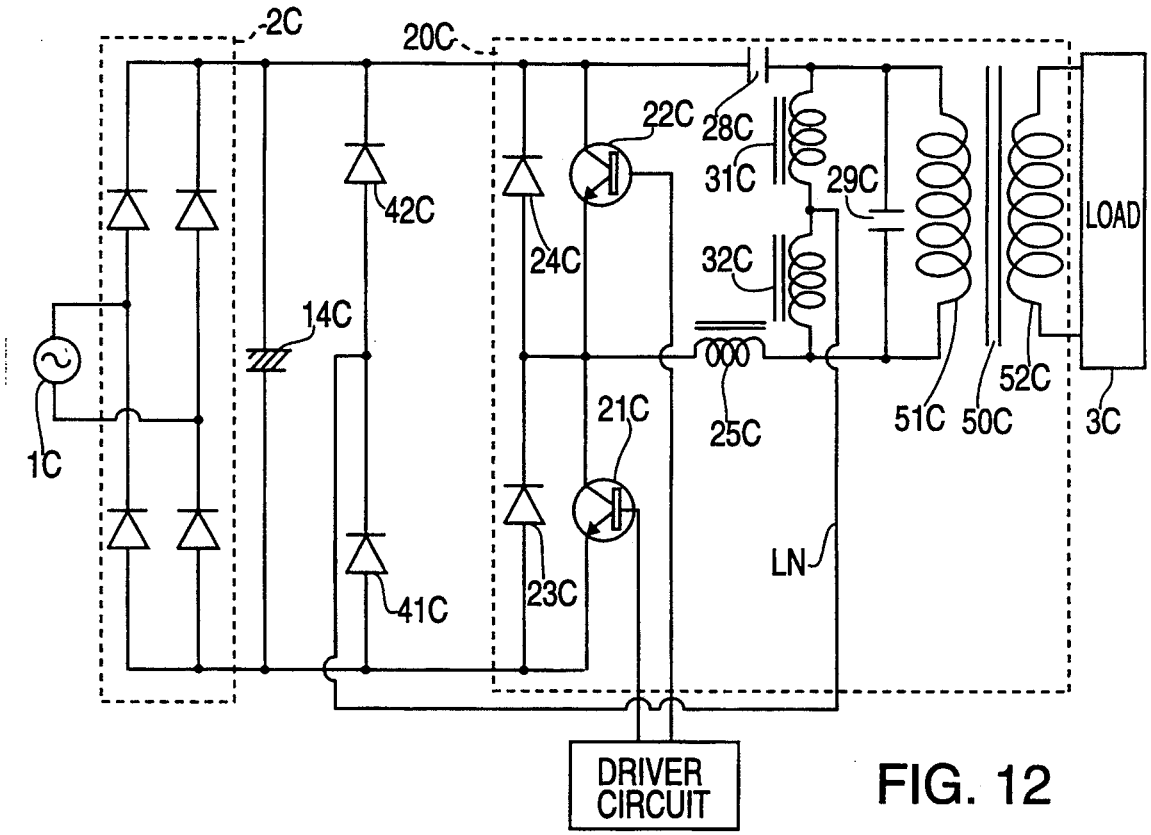

FIG. 12 illustrates a second modification of the second embodiment which is identical to the second embodiment except that a series connected pair of inductors 31C and 32C is connected across the primary winding 51C as the impedance elements, instead of the capacitors 31A and 32A, to give a divided voltage indicative of the output voltage of the inverter 20C. The operation is identical to that of the first embodiment and therefore no duplicate explanation is made herein. Like elements are designated by like numerals with a suffix letter of "C".

Figure 13:
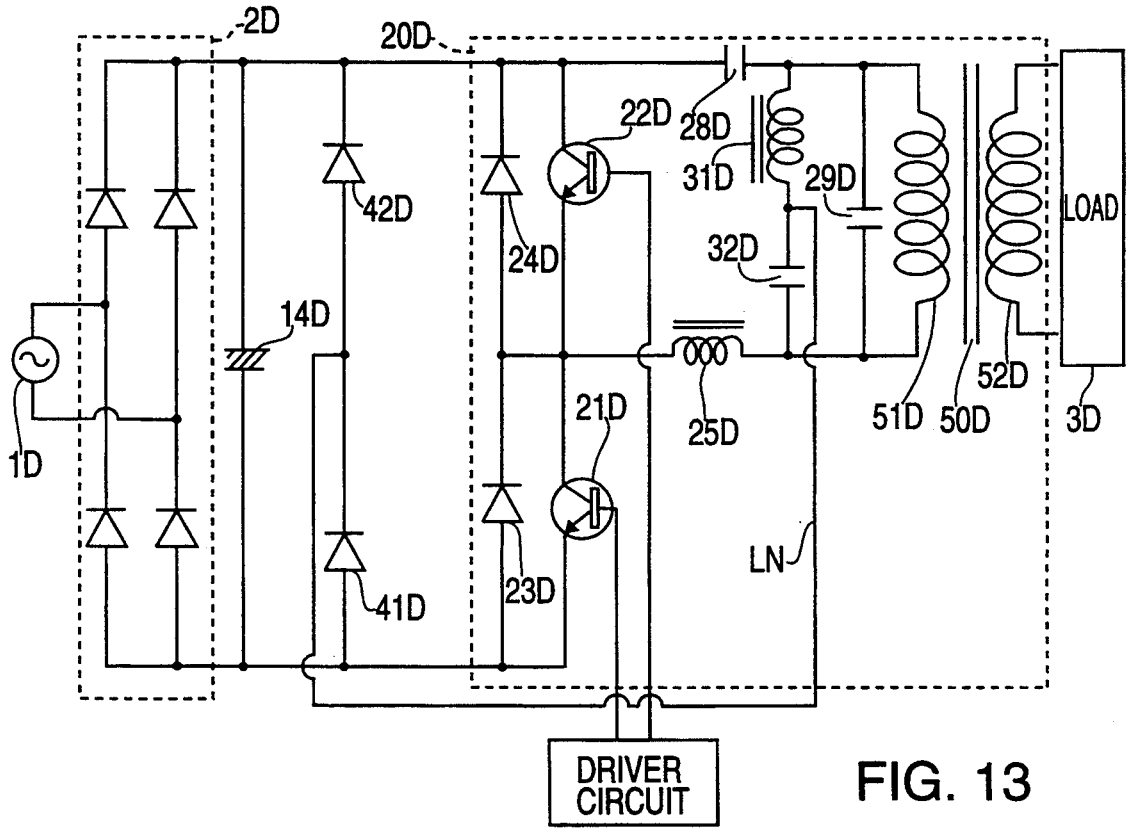

FIG. 13 illustrates a third modification of the second embodiment which is identical to the second embodiment except that a series connected pair of an inductors 31D and a capacitor 32D is connected across the primary winding 51C as the impedance elements, instead of the capacitors 31A and 32A, to give a divided voltage indicative of the output voltage of the inverter 20D. The operation is identical to that of the first embodiment and therefore no duplicate explanation is made herein. Like elements are designated by like numerals with a suffix letter of "D".

Figure 14:
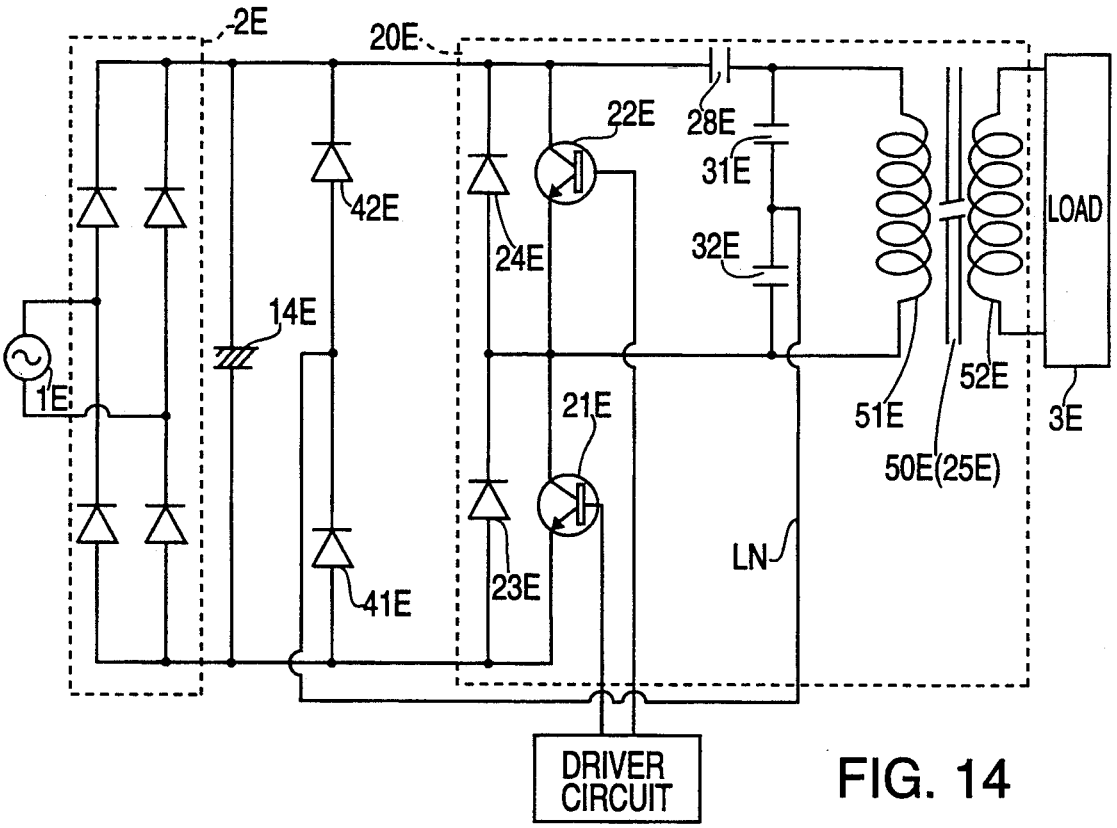
FIG. 14 is a circuit diagram of a power supply in accordance with a third embodiment of the present invention.

Third Embodiment <FIG. 14>

FIG. 14 illustrates a power supply in accordance with a third embodiment of the present invention which is identical to the first embodiment except that the output transformer 50E is in the form of a leakage transformer with a leakage inductance which is utilized instead of the inductor 25 to form a like series L-C resonant circuit with capacitors 31E and 32E. Also in this embodiment, transistors 21E and 22E are controlled by a driver circuit to alternately turn on and off. The operation is identical to that of the first embodiment and therefore no duplicate explanation is made herein. Like elements are designated by like numerals with a suffix letter of "E".

Figure 15:
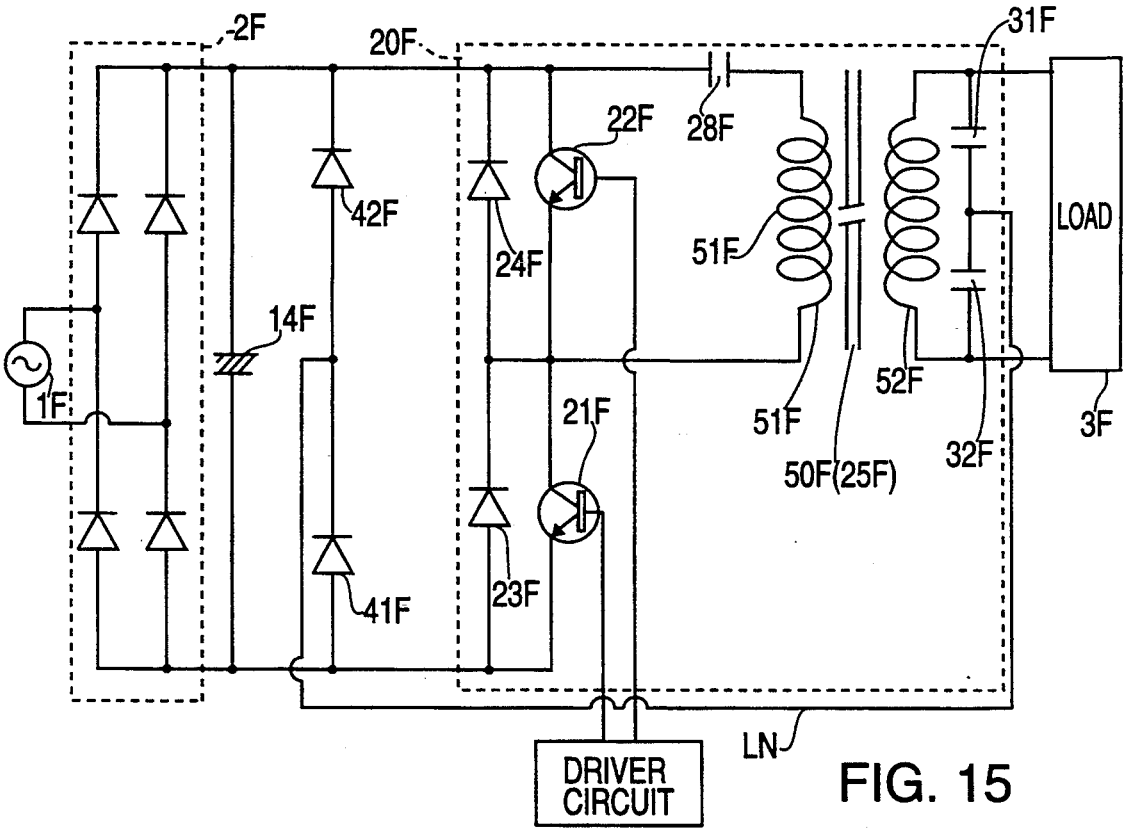
FIG. 15 is a circuit diagram of a modification of the power supply of FIG. 13.

FIG. 15 illustrates a modification of the third embodiment which is identical thereto except that a series connected pair of capacitors 31F and 32F is connected across the secondary winding 52F of the output transformer 52F to give a divided voltage indicative of the output voltage of the inverter. The operation is identical to that of the first embodiment and therefore no duplicate explanation is made herein. Like elements are designated by like numerals with a suffix letter of "F".

Figure 16:
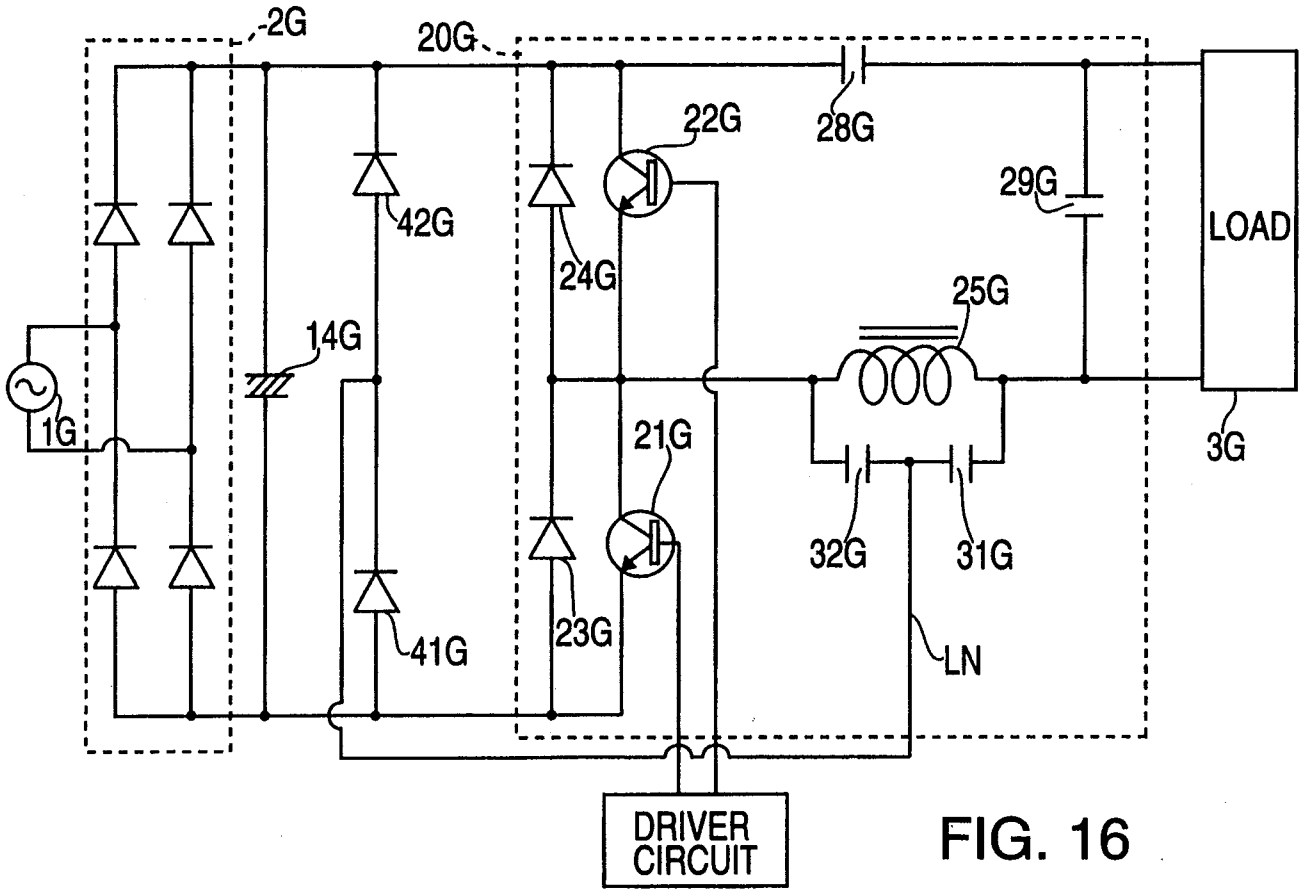
FIG. 16 is a circuit diagram of a power supply in accordance with a fourth embodiment of the present invention.

Fourth Embodiment <FIG. 16>

FIG. 16 illustrates a power supply in accordance with a fourth embodiment of the present invention which is similar to the second embodiment except that a load 3G is connected directly across capacitor 29G without interposing an output transformer therebetween, and that a series connected pair of capacitors 31G and 32G is connected across the inductor 25G to give a divided voltage indicative of the output voltage of the inverter 20G. In this embodiment, it is equally possible to limit the output voltage of the inverter by permitting a like clamping current ID to flow selectively through the clamping diodes 41G and 42G depending upon the polarity of the output AC voltage, as shown in FIGS. 17A to 17D.

Figure 17C:
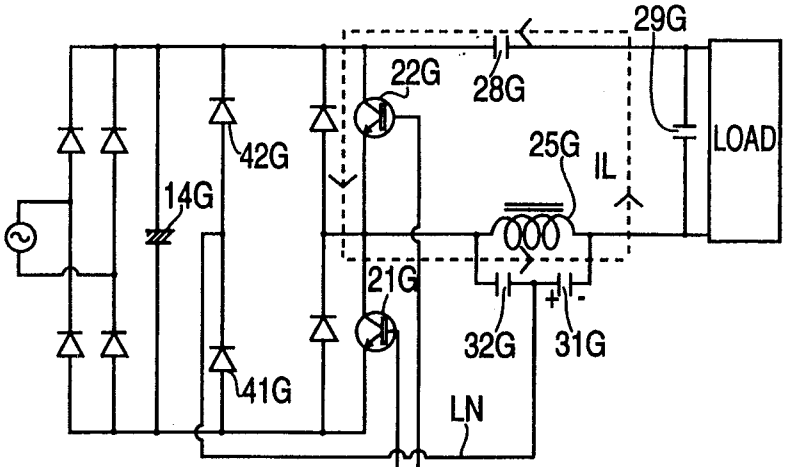
FIGS. 17A to 17D are diagram illustrating the current flowing through the circuit of the power supply of FIG. 16.
Figure 17D:
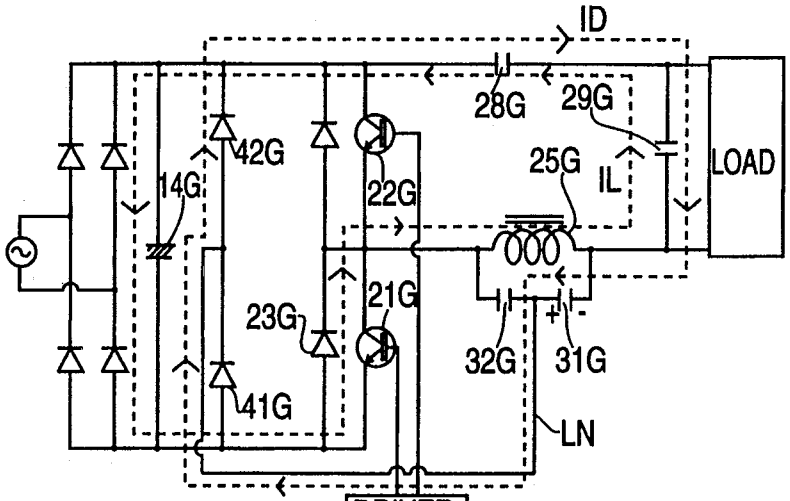
Figure 17A:
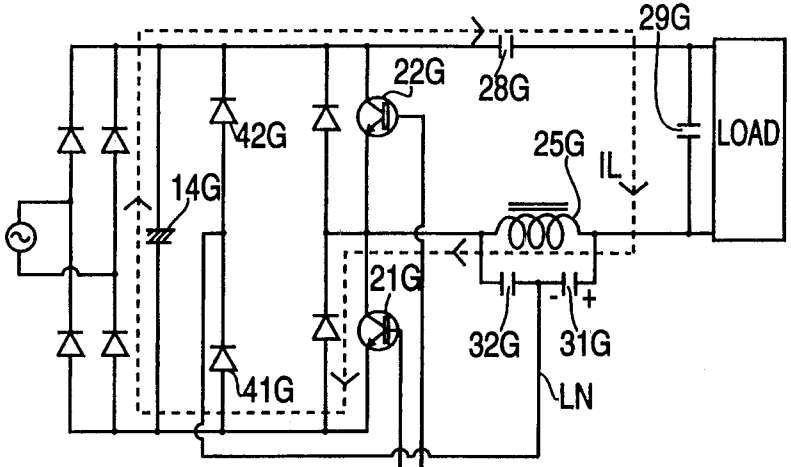
Figure 17B:
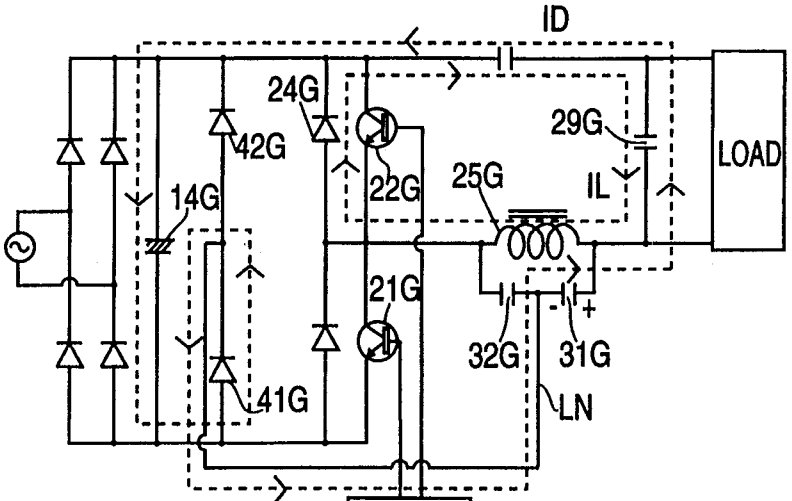

In detail, when the L-C resonant circuit of inductor 25G and capacitor 29G produces an excessively high voltage under an increased load condition after the first transistor 21G is turned on to flow the current IL, as shown in FIG. 17A, to charge the capacitor 31G with a polarity as indicated in the figure, a correspondingly high potential difference is developed across capacitor 31G which is greater than the DC voltage of the smoothing capacitor 14G plus the forward bias of the first clamping diode 41G. Upon this occurrence, the first clamping diode 41G becomes conductive to flow a clamping current ID through capacitor 31G, capacitor 28G, smoothing capacitor 14G, diode 41G, and line LN, as shown in FIG. 17B.

When, on the other hand, the L-C resonant circuit produces an excessively high voltage of opposite polarity under the increased load condition after the second transistor 22G is turned on to flow the current IL, as shown in FIG. 17C, to charge the capacitor 31G with the opposite polarity as indicated in the figure, a correspondingly high potential difference is developed across capacitor 31G which is greater than the DC voltage of the smoothing capacitor 14G plus the forward bias of the second clamping diode 42G. Upon this occurrence, the second clamping diode 42G becomes conductive to flow a clamping current ID through capacitor 31G, line LN, diode 42G, capacitor 28G, and capacitor 29G, as shown in FIG. 17D. In this manner, the clamping current ID is responsible for limiting the output voltage of the inverter below the predetermined level as well as for protecting transistors 21G and 22G from unduly high current which would otherwise appear. It should be noted in this connection that the clamping current ID will not flow through the inductor 25G so as to keep the inductor 25G free from being heated by the clamping current. Although in this embodiment the capacitors 31G and 32G are utilized as impedance elements to form a divider of the output voltage of the inverter, it is equally possible to use a pair of series connected resistors, a pair of series connected inductors, or a pair of series inductor and capacitor to form a like divider.

Figure 18:
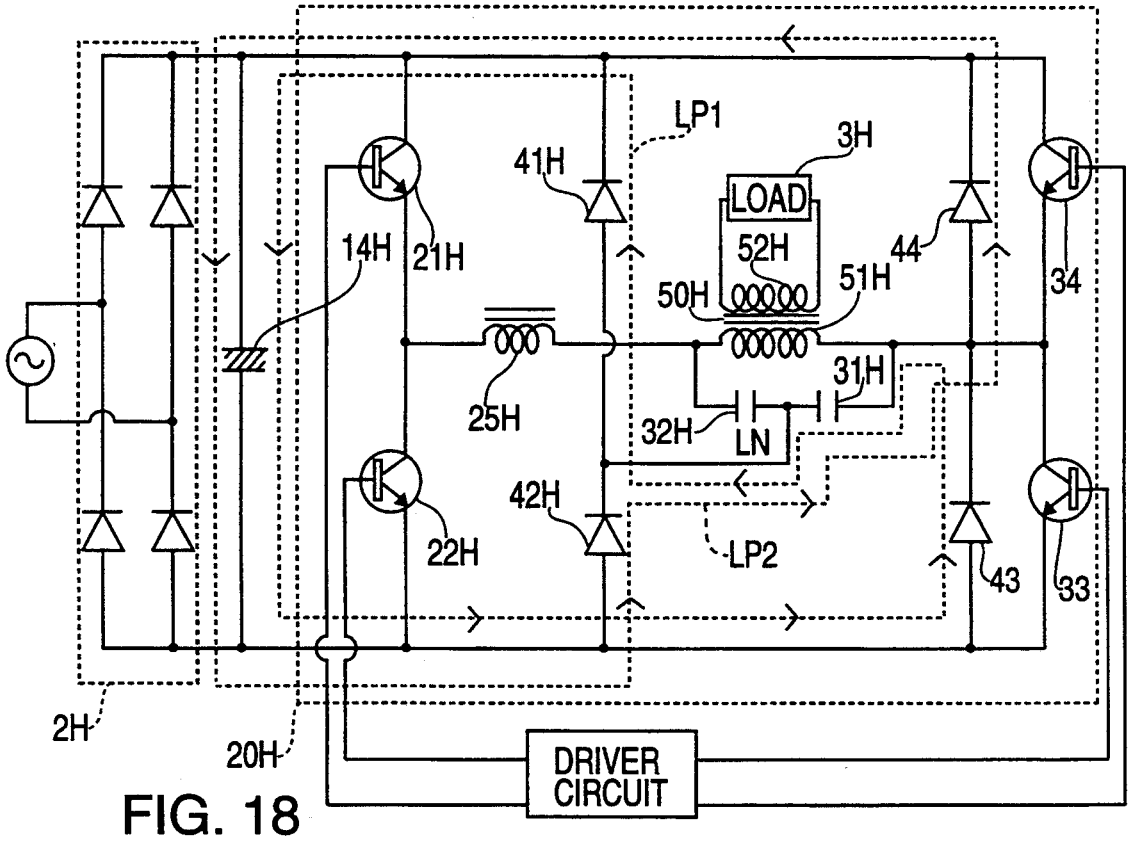
FIG. 18 is a circuit diagram of a power supply in accordance with a fifth embodiment of the present invention.

Fifth Embodiment <FIG. 18>

FIG. 18 illustrates a power supply in accordance with a fifth embodiment of the present invention which comprises a like rectifier 2H providing a smoothed DC voltage to a smoothing capacitor 14H, and an inverter 20H having two pairs of transistors 21H, 33, and 22H, 34 arranged in a full-bridge configuration. Connected between the bridge output terminals is a series L-C resonant circuit composed of an inductor 25H and a series pair of capacitors 31H and 32H. Diodes 43 and 44 are connected across transistors 33 and 34 respectively in anti-parallel relation thereto. An output transformer 50H is connected in circuit with its primary winding 51H connected across the series pair of capacitors 31H and 32H and with its secondary winding 52H connected to a load 3H. The capacitors 31H and 32H constitute a divider for giving a divided voltage indicative of the output voltage of the inverter 20H, while defining a first connection point between capacitors 31H and 32H. Clamping diodes 41H and 42H are connected in series across the series pair of transistors 21H and 22H in anti-parallel relation thereto. A second connection point is defined between diodes 41H and 42H and is connected through a line LN to the first connection point between capacitors 31H and 32H. Also in this embodiment, the connection point between the capacitors 31H and 32H is clamped to a level nearly equal to the input DC voltage, or the voltage supplied from smoothing capacitor 14H even when the L-C resonant circuit tends to produce an excessively high voltage in response to the increase in the load impedance, thereby limiting the output voltage below a predetermined level by allowing a clamping current selectively through loops LP1 and LP2 each including each one of clamping diodes 41H and 42H and each one of diodes 43 and 44, as indicated in the figure.

That is, when transistors 21H and 33 are turned on with an increased load impedance, the clamping current is allowed to flow through the loop LP1 including diode 41H, smoothing capacitor 14H, and diode 43. On the other hand, when transistors 22H and 34 are turned on with the increased load impedance, the clamping current is allowed to flow through the loop LP2 including diode 44, smoothing capacitor 14H, and diode 42H. Further, it is known from the figure that the clamping current will not flow either through the inductor 25H or the primary winding 51H of the output transformer so as not to cause any undesirable heat build-up thereat.

Figure 19:
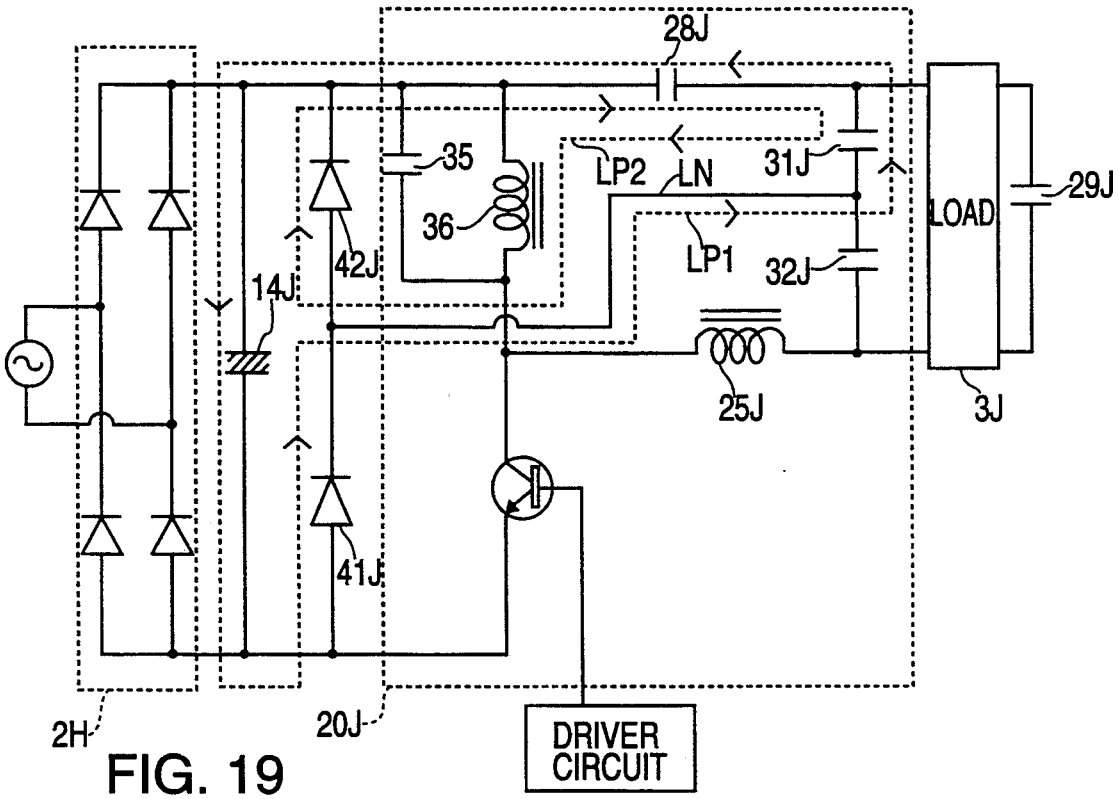
FIG. 19 is a circuit diagram of a power supply in accordance with a sixth embodiment of the present invention.

Sixth Embodiment <FIG. 19>

FIG. 19 illustrates a power supply in accordance with a sixth embodiment of the present invention which includes a like rectifier 2J providing a smoothed DC voltage at a smoothing capacitor 14J and an inverter 20J with a single transistor 21J which is connected in series with a parallel L-C resonant circuit of a capacitor 35 and 36 across the smoothing capacitor 14J. The inverter includes a series L-C resonant circuit which is composed of an inductor 25J and capacitor 29J and which is connected in series with a coupling capacitor 28J across the parallel L-C resonant circuit. A load 3J is connected across the capacitor 29J. Transistor 21J is controlled by a driver circuit to turn on and off to provide a high frequency AC output voltage across the series pair of capacitors 31J and 32J. Capacitors 31J and 32J are connected in series across capacitor 29J to form a divider which gives a divided voltage indicative of the output voltage of the inverter 20J and define therebetween a first connection point. A pair of clamping diodes 41J and 42J are connected across the smoothing capacitor 14J in an anti-parallel relation thereto, while defining between diode 41J and 42J a second connection point which is connected through a line LN to the first connection point. Also in this embodiment, therefore, the connection point between capacitors 31J and 32J is clamped at a level nearly equal to the input DC voltage from the smoothing capacitor 14J even when the L-C resonant circuit tends to produce an excessively high voltage in response to the increase in the load impedance, so that the output voltage of the inverter 20J can be limited below a predetermined level by allowing a clamping current selectively through loops LP1 and LP2 each including each one of clamping diodes 41J and 42J, as indicated in the figure.

Figure 20:
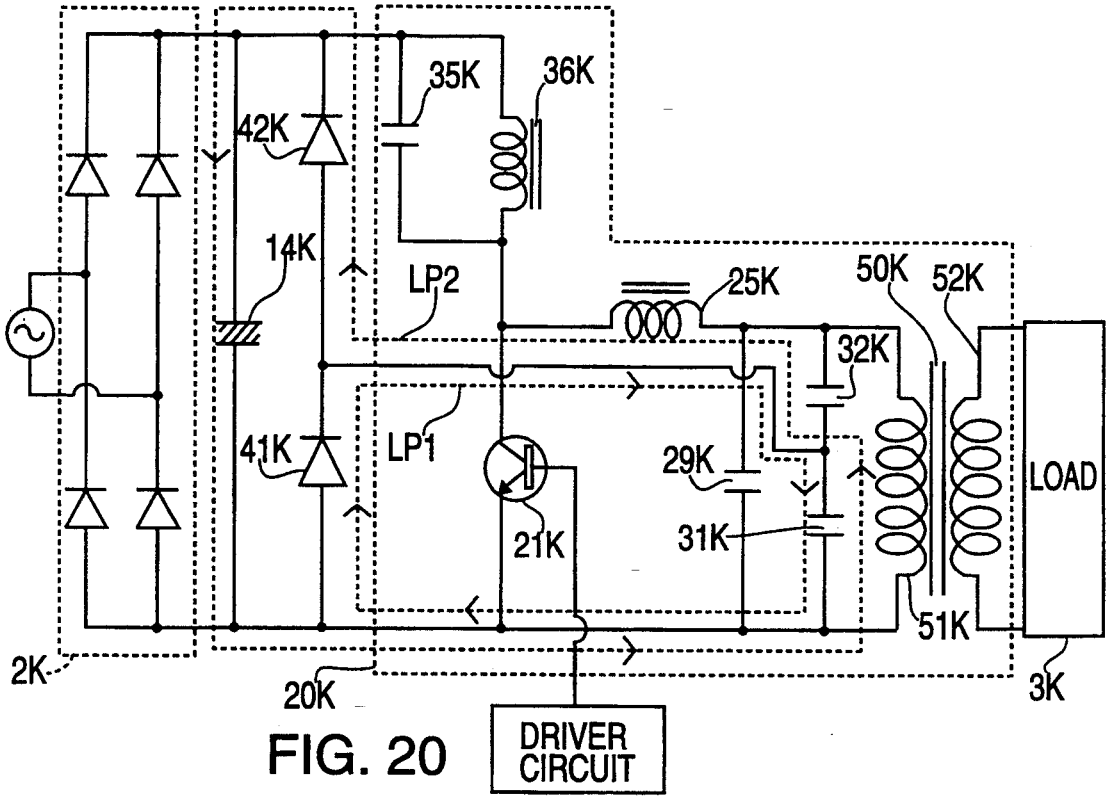
FIGS. 20 and 21 are circuit diagrams of first and second modifications of the power supply of FIG. 19.

FIG. 20 illustrates a first modification of the sixth embodiment which is similar to the sixth embodiment except that a series L-C resonant circuit of inductor 25K and capacitor 29K is connected across the transistor 21K and that an output transformer 50K is utilized to have its primary winding connected across the capacitor 29K and to have its secondary winding 52K connected to a load 3K. Like elements are designated by like numerals with a suffix letter of "K". This modification operates similarly as in the embodiment of FIG. 20 to effect like clamping operation of limiting the inverter output voltage below a predetermined level, while flowing a clamping current selectively through loops LP1 and LP2 each including each one of diodes 41K and 42K, as indicated in the figure.

Figure 21:
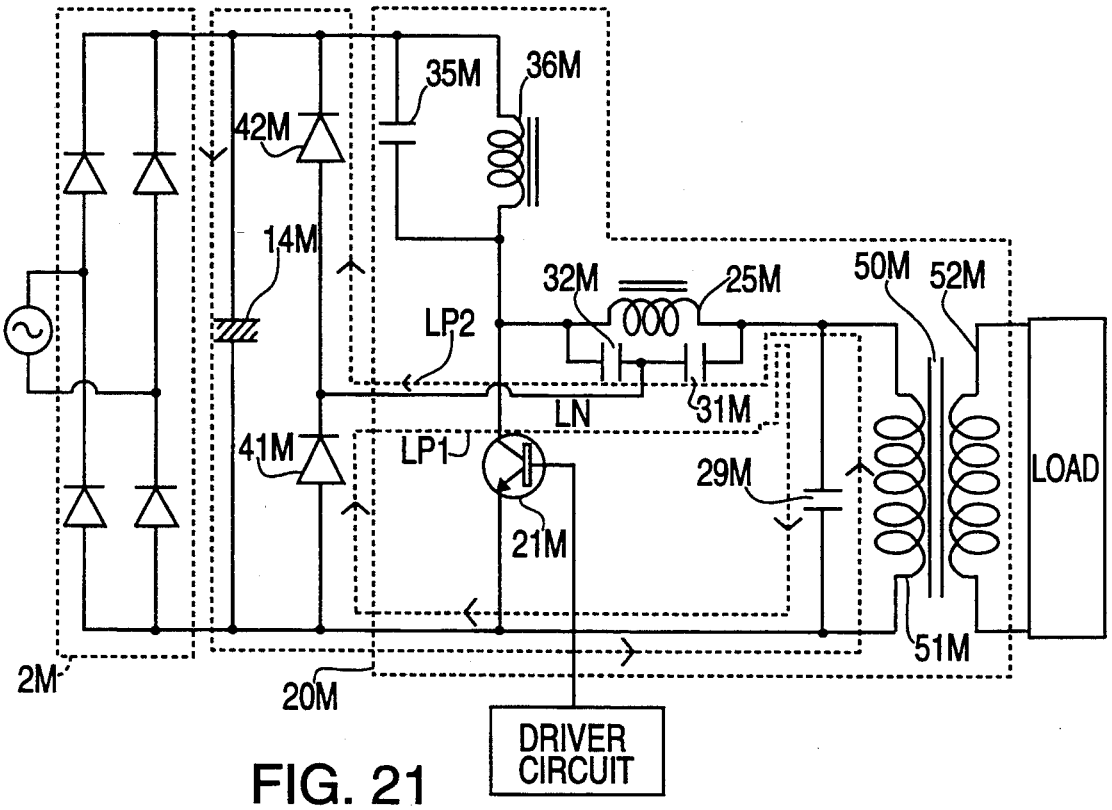

FIG. 21 illustrates a second modification of the sixth embodiment which is similar to the sixth embodiment except that a series L-C resonant circuit of inductor 25M and capacitor 29M is connected across the transistor 21M, that an output transformer 50M is utilized to have its primary winding connected across the capacitor 29M and to have its secondary winding 52M connected to a load 3M, and that capacitors 31M and 32M are connected in series across the inductor 25M to define a like divider. Like elements are designated by like numerals with a suffix letter of "K". This modification operates similarly as in the embodiment of FIG. 20 to effect like clamping operation of limiting the inverter output voltage below a predetermined level, while flowing a clamping current selectively through loops LP1 and LP2 each including each one of diodes 41M and 41M, as indicated in the figure.

In the circuit of FIGS. 19 to 21, it is equally possible to use, instead of series connected pair of capacitors, a pair of series connected resistors, a pair of series connected inductors, or a pair of series inductor and capacitor, to give an divided voltage indicative of the inverter output.

Seventh Embodiment <FIG. 22>

FIG. 22 illustrates a power supply in accordance with a seventh embodiment of the present invention which is adapted to drive a discharge lamp 3N with cathodes 4. The power supply is basically identical to the first embodiment but further includes a fault detector 7 which alarms the occurrence of abnormal condition that the discharge lamp 3N is detached or the lamp 3N is deteriorated to increase its impedance remarkably, for example, in a case of half-wave discharging wherein only one of cathodes remains active to flow a current in one direction only as is frequently seen in the end of the lamp life. Like elements are designated by like numerals with a suffix letter of "N". The inverter operation and the clamping operation are identical to the first embodiment, therefore no duplicate explanation is repeated herein.

The fault detector 7 is made active only when the inverter sees a clamping current for limiting the inverter output in response to the abnormal condition. For this purpose, a transformer is connected in circuit with its primary winding 45 inserted in the line LN connecting the first and second connection points to induce a corresponding voltage at its secondary winding 46 when the clamp current flows through the line LN. The secondary winding 46 is connected through a diode 47 and a resistor 48 to charge a capacitor 49 for activating the fault detector 7. Consequently, the fault detector 7 is made active only upon the clamping current flows as a result of the abnormal condition. The fault detector 7 acts to reduce the ON-period of transistor 21N and therefore lower the output voltage of the inverter for dimming the lamp 3N when there arises the abnormal condition in which the lamp 3N is deteriorated to increase its impedance, thereby notifying an user of the occurrence of the abnormal condition and requiring the replacement of the lamp.

The fault detector 7 comprises a first section 70 which controls to reduce the ON-period of transistor 21N, and a second section 90 which is energized by capacitor 49 so as to activate the first section 70 only when the clamp current flows in response to the abnormal condition. The first section 70 is connected at points A, B, and C respectively to the first feedback winding 26N, and auxiliary windings 71 and 72 coupled to the inductor 25N. The first section 70 includes a transistor 73 which is connected to turn off the first transistor 21N of the inverter 20N to reduce the ON-period thereof upon the occurrence of the abnormal condition. Transistor 73 is connected across with a smoothing capacitor 74 which is supplied with an operating voltage from the winding 71 as well as from capacitor 49 through the second section 90 and through a diode 95. Connected to a base of transistor 73 is an output of a comparator 75 having its inverting input connected to a divided point between resistors 76 and 77 which are connected in series across capacitor 74. A noninverting input of comparator 75 is connected to a divided point between a resistor 78 and a capacitor 79 which are connected across capacitor 74. Capacitor 79 is shunted by a transistor 80 of which base-emitter path is shunted by another transistor 81. Transistor 81 has its base connected through a resistor 82 to the winding 72 with a diode 83 connected in a base-emitter path of transistor 82. The winding sense of winding 72 is such that the winding 72 give a bias to turn on transistor 81 when first feedback winding 26N gives the bias to turn on the first transistor 21N by the current flowing through the inductor 25N. That is, transistor 81 is turned on at the same time the first transistor 21N is turned on and is kept turned off when the first transistor 21N is turned off. When transistor 81 is turned on, transistor 80 is turned off to allow capacitor 79 to be charged through resistor 78 by a current from capacitor 74 so as to give a corresponding voltage to the non-inverting input of comparator 75. When capacitor 79 gives the voltage which exceeds a threshold voltage fed to the inverting input of comparator 75, comparator 75 responds to produce a high level output to turn on transistor 73, thereby turning off the first transistor 21N.

The threshold voltage is enabled to vary between a high level which is determined solely by resistors 76 and 77 and a low level which is determined by resistor resistors 76 and 77 and also by a resistor 94 provided in the second section 90. As will be discussed hereinafter, the threshold voltage is normally set at the high level and is lowered to the low level only when the abnormal condition is detected. The high level is selected such that the voltage from capacitor 79 will not exceed the threshold voltage of comparator 75 to thereby keep transistor 73 turned off and therefore will not control to turn off the first transistor 21N. On the other hand, the low level is selected such that the voltage from the capacitor 79 can exceed the threshold level. That is, when the threshold voltage is set at the low level in response to the abnormal condition, capacitor 79 is charged to give the voltage which exceeds the threshold level within a time period determined by time constant of resistor 78 and capacitor 79 from the instant when transistor 80 is turned off in response to the turn-on of the first transistor 21N. The time period is selected to be less than a normal ON-time period of the first transistor 21N so that capacitor 79 acts as a timer to reduce the ON-period of the first transistor 21N in a sense that as soon a capacitor 79 is charged to exceed the threshold voltage at the low level, the first transistor 21N is compulsively turned off.

The second section 90 includes a voltage divider of resistors 91 and 92 connected to receive a voltage from capacitor 49 for giving a high level voltage to an inverter 93 which in turn produces a low voltage defining a ground level of the circuit. It is the resistor 94 that is inserted between the inverter 93 and a connection between resistors 76 and 77 so that when the second section 90 receives the voltage from capacitor 49, resistor 94 becomes connected in parallel with resistor 77 so as to lower the potential at the connection between resistors 76 and 77, thereby lowering the threshold voltage of comparator 75 to the low level. Consequently, when capacitor 49 develops the voltage due to the clamping current flowing through the line LN as indicative of the abnormal condition, the fault detector is made active to reduce the ON-period of the first transistor 21N with an attendant lowering in the output voltage of the inverter 20N. In the absence of the abnormal condition in which capacitor 49 is not charged, the threshold voltage of comparator 75 is kept at the high level so that the fault detector is not active to reduce the ON-period of the first transistor 21N. It is noted in this connection that the voltage from capacitor 49 is fed through diode 95 to capacitor 74 so that the voltage derived from the clamping current can be best utilized to give the operating voltage to the first section 70.

Thus configured fault detector 70 may be equally applicable to the other embodiments and various modifications of the present invention. Further, it is noted that the above fault detector 70 may include an additional alarm circuit which is energized by the clamping current through the line LN, or the voltage from capacitor 49 to give an alarm indication such as by lighting an alarm lamp or issuing an alarm sound. Such alarm circuit may be alone utilized to notify the abnormal condition rather than lowering the inverter output.

Figure 23:
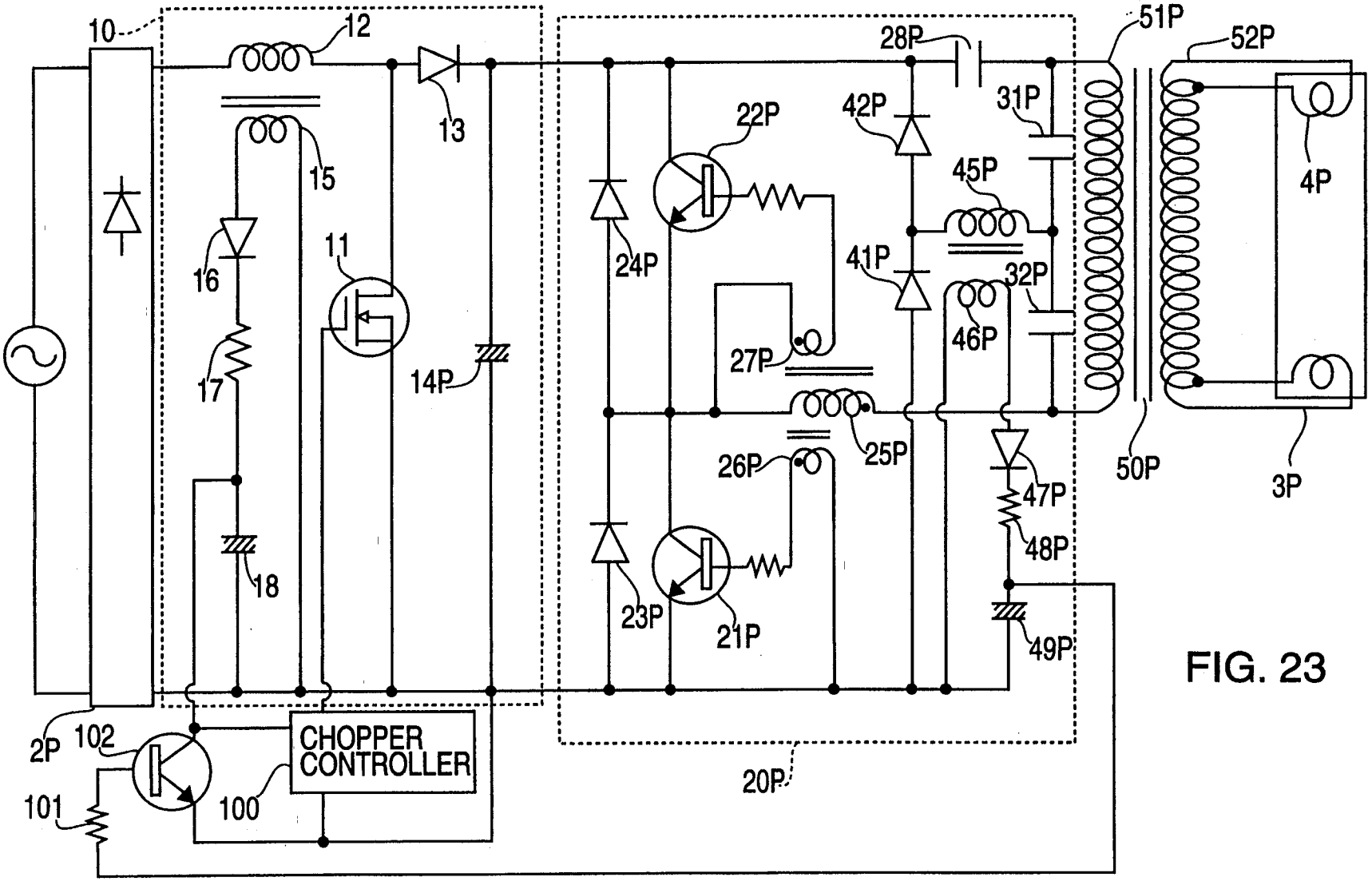
FIG. 23 is a circuit diagram of a power supply in accordance with an eighth embodiment of the present invention.

Eighth Embodiment <FIG. 23>

FIG. 23 illustrates a power supply in accordance with an eighth embodiment of the present invention which is similar to the seventh embodiment but includes a chopper 10 which gives a step-up DC voltage to an inverter 20P from an AC mains 1P through a like rectifier 2P. A fault detector in this embodiment operates to lower an output voltage of the chopper 10 and therefore lower the inverter output correspondingly. Like elements are designated by like numerals with a suffix letter of "P". The chopper 10 includes a MOSFET 11 which is connected in series with an inductor 12 across the rectifier 2P. MOSFET 11 is driven by a chopper controller 100 to turn on and off for providing an interrupted DC voltage which is fed through a blocking diode 13 to a smoothing capacitor 14P in addition to a pulsating DC voltage from the rectifier 2P to accumulate a step-up smoothed DC voltage at the smoothing capacitor 14P which is supplied as a fixed DC voltage to the inverter 20P. The chopper controller 100 is of conventional design for repetitively turn on and off MOSFET 11 and derived its operating voltage from an auxiliary winding 15 which is coupled to the inductor 12 to give an induced voltage as the current flows through inductor 12. The induced voltage is fed through a diode 16 and a resistor 17 to charge a capacitor 18 which is connected to energize the controller 100.

The fault detector comprises a transformer with a primary winding 45P inserted in a line LN connecting the first and second connection points to induce a corresponding voltage at its secondary winding 46P when the clamp current flows through the line LN in response to the abnormal load condition. The secondary winding 46P is connected through a diode 47P and a resistor 48P to charge a capacitor 49P which is connected through a resistor 101 to give a bias to a transistor 102. Transistor 102 is connected to shunt a voltage feeding path to the chopper controller 100 from capacitor 18 so as to disable the controller 100 when transistor 102 is turned on in response to the abnormal load condition. Consequently, upon occurrence of the abnormal load condition, the controller 100 is disabled to cease operating MOSFET 11 to thereby stop providing an additional voltage from the chopper 10 to the inverter 20P. Whereby, the inverter 20P operates on a lowered DC voltage which is supplied only directly from the rectifier 2P to smoothing capacitor 14P, thus lowering the inverter output. Once this occurs to lower the voltage of smoothing capacitor 14P, the connection point between capacitors 31P and 32P is correspondingly lowered so that the clamping current will be more likely to flow for assuring to limit the inverter output even with the abnormal load condition is more or less reduced.

Figure 24:
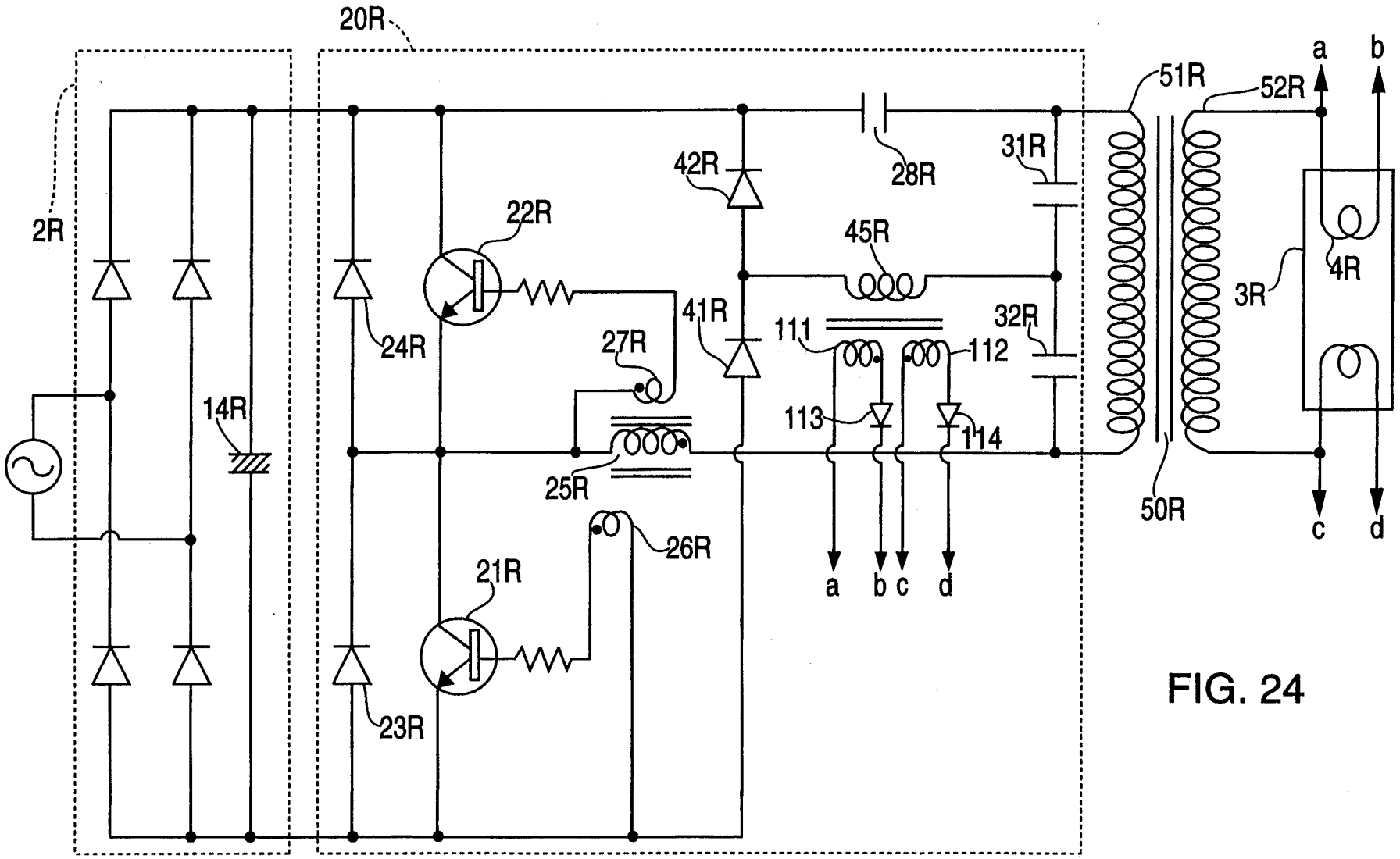
FIG. 24 is a circuit diagram of a power supply in accordance with a ninth embodiment of the present invention.

Ninth Embodiment <FIG. 24>

FIG. 24 illustrates a power supply in accordance with a ninth embodiment of the present invention which is similar to the embodiment of FIG. 22 but includes a pair of secondary windings 111 and 112 coupled to a primary winding 45R for heating respective cathodes 4R of the discharge lamp 4R instead of activating the fault detector. Like elements are designated by like numerals with a suffix letter of "R". At the start of the discharge lamp 3R, the lamp 3R shows an increased impedance such that the clamping current will flow through the line LN between the first connection point of capacitors 31R and 32R and the second connection point of clamping diodes 41R and 42R, and therefore through the primary winding 45R to give a induced voltage at each one of windings 111 and 112. The resulting voltages are fed respectively through diodes 113 and 114 to heat the cathodes 4R of the lamp 3R to facilitate the ignition thereof. In other words, the excessive voltage developed at the start of the lamp 3R due to the high impedance is best utilized to heat the cathodes of the lamp for expediting the lighting thereof.

Figure 25:
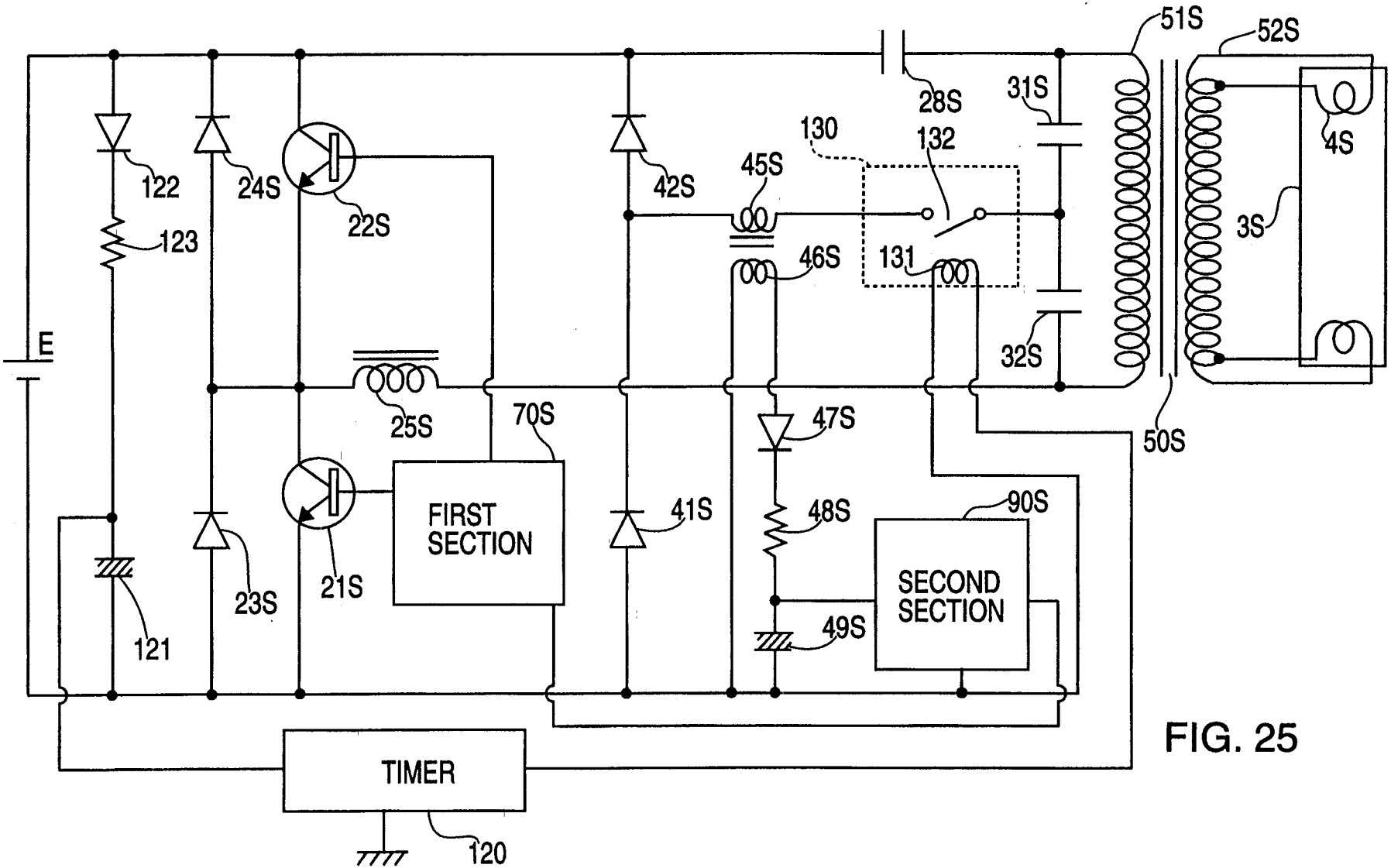
FIG. 25 is a circuit diagram of a power supply in accordance with a tenth embodiment of the present invention.

Tenth Embodiment <FIG. 25>

FIG. 25 illustrates a power supply in accordance with a tenth embodiment of the present invention which is basically identical to the embodiment of FIG. 22 but additionally includes a timer 120 for disabling the operation of limiting the inverter output only for a short time interval after the start of the inverter. Like elements are designated by like numerals with a suffix letter of "S". The timer 120 is energized by a voltage accumulated at a capacitor 121 which is connected in series with a diode 122 and a resistor 123 across the input DC voltage E of the inverter. The timer 120 is connected to a normally-closed relay 130 with an excitation coil 131 and a switch 132 inserted in the line LN in series with the primary winding 45S between the first connection point of capacitors 31S and 32S and the second connection point of clamping diodes 41S and 42S. The primary winding 45S is coupled to the secondary winding 46S which, in response to the abnormal load condition, activates the fault detector composed of the first section 70S and the second section 90S in a like manner as in the embodiment of FIG. 22 to limit the inverter output by reducing the ON-period of the first transistor 21S. The first section 70S may be designed to reduce the ON-period of the second transistor 22S in addition to the first transistor 21S.

Figure 26:
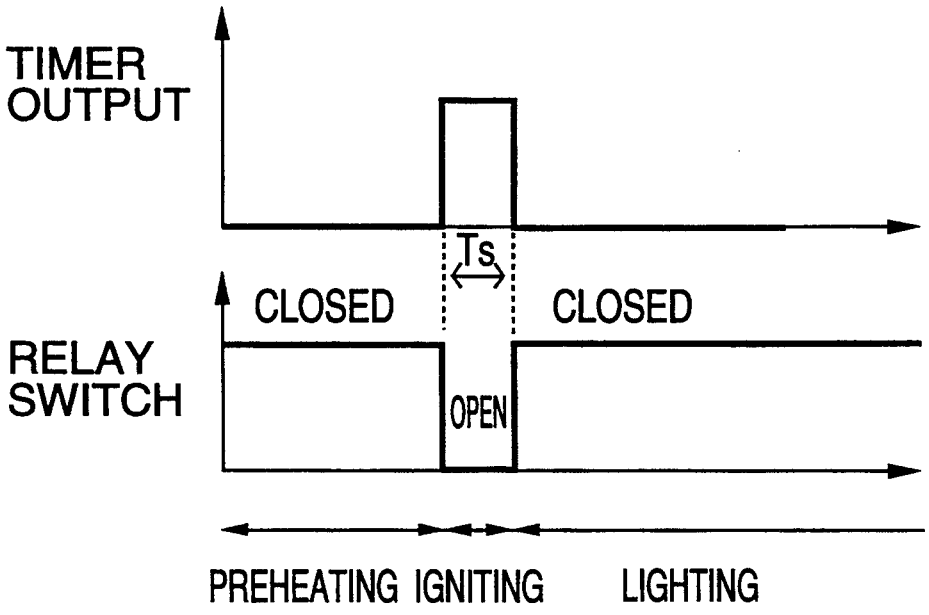
FIG. 26 is a waveform chart illustrating the operation of the circuit of FIG. 25.

The timer 120 is configured to issue an ON signal to open the switch 132 once and only for the short time period Ts, as shown in FIG. 26, to disable the operation of limiting the inverter output by the fault detector, and otherwise does not issue the ON signal to keep the switch 132 closed, enabling the fault detector to limit the inverter output. The time period Ts is selected to appear with a delay from the energization of the circuit in which the cathodes of the lamp 4S is preheated. Subsequently when the switch 132 is opened, the inverter is allowed to apply an excessive voltage as a starting voltage only for the short time period Ts to facilitate the ignition of the lamp 3S, after which the fault detector is enabled to limit the inverter output for protection of the transistors when the abnormal load condition occurs.

It should be noted that the features of the above embodiments as well as the modifications could be suitably gathered to achieve a more sophisticated operation as well as an effective circuit configuration.

What is claimed is:

1. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter under a no-load condition, said first and second impedance elements defining therebetween a second connection point, said first and second connection points being connected to each other in order to limit the output voltage of said inverter under the no-load condition below a predetermined level.

2. A power supply as set forth in claim 1, wherein said inverter includes a coupling capacitor and a pair of first and second switching elements connected across said DC voltage source, and wherein said L-C resonant circuit comprises resonant inductor means and resonant capacitor means which are connected in series with said coupling capacitor across one of said first and second switching elements to define a series L-C resonant circuit, said resonant capacitor means composed of a pair of first and second capacitors which are connected in series across said inverter output to define said first and second impedance elements, respectively.

3. A power supply as set forth in claim 1, wherein said inverter includes a coupling capacitor and a pair of first and second switching elements connected across said DC voltage source, and wherein said L-C resonant circuit comprises resonant inductor means and capacitor means which are connected in series with said coupling capacitor across one of said first and second switching elements to define a series L-C resonant circuit, said resonant capacitor means defining thereacross said inverter output, and said first and second impedance means being in the form of first and second capacitors, respectively, which are connected in series across said resonant capacitor means.

4. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance elements defining therebetween a second connection point, said first and second connection points being connected to each other in order to limit the output voltage of said inverter below a predetermined level, wherein said inverter includes a coupling capacitor and a pair of first and second switching elements connected across said DC voltage source, and wherein said L-C resonant circuit comprises resonant inductor means and capacitor means which are connected in series with said coupling capacitor across one of said first and second switching elements to define a series L-C resonant circuit, said resonant capacitor means defining there across said inverter output, and said first and second impedance means being in the form of first and second resistors, respectively, which are connected in series across said resonant capacitor means.

5. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diode defining therebetween a first connection point;

a series connected pair of first and second impedance elements connected in circuit to provide a divided voltage indicative of an output voltage of said inverter, said first and second impedance elements defining therebetween a second connection point, said first and second connection points being connected to each other in order to limit the output voltage of said inverter below a predetermined level, wherein said inverter includes a coupling capacitor and a pair of first and second switching elements connected across said DC voltage source, and wherein said L-C resonant circuit comprises resonant inductor means and capacitor means which are connected in series with said coupling capacitor across one of said first and second switching elements to define a series L-C resonant circuit, said resonant capacitor means defining thereacross said inverter output, and said first and second impedance means being in the form of first and second inductors, respectively, which are connected in series across said resonant capacitor means.

6. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance element defining therebetween a second connection point, said first and second connection points being connected to each other in order to limit the output voltage of said inverter below a predetermined level, wherein said inverter includes a coupling capacitor and a pair of first and second switching elements connected across said DC voltage source, and wherein said L-C resonant circuit comprises resonant inductor means and capacitor means which are connected in series with said coupling capacitor across one of said first and second switching elements to define a series L-C resonant circuit, said resonant capacitor means defining thereacross said inverter output, and said first and second impedance means being in the form of an inductor and a capacitor, respectively, which are connected in series across said resonant capacitor means.

7. A power supply as set forth in claim 1, wherein said inverter includes an output transformer with a primary winding and a secondary winding, said primary winding being connected in circuit to define thereacross said inverter output which is coupled through said secondary winding to said load.

8. A power supply as set forth in claim 7, wherein said output transformer is a leakage transformer having a leakage inductance which defines said inductor means and is cooperative with resonant capacitor means to form said L-C resonant circuit.

9. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance elements defining therebetween a second connection point, said first and second connection points being connected to each other in order to limit the output voltage of said inverter below a predetermined level, wherein said inverter includes an output transformer with a primary winding and a secondary winding, said primary winding being connected in circuit so as to define said inverter output across said secondary winding, said first and second impedance elements connected across said secondary winding,

10. A power supply as set forth in claim 1, wherein said inverter includes a coupling capacitor and a pair of first and second switching elements connected across said DC voltage source, and wherein said L-C resonant circuit comprises resonant inductor means and capacitor means which are connected in series with said coupling capacitor across one of said first and second switching elements to define a series L-C resonant circuit, said first and second impedance elements connected in series across said resonant inductor means, while said resonant capacitor means defines thereacross said output of said inverter.

11. A power supply as set forth in claim 1, wherein said inverter comprises four switching elements arranged in a full-bridge configuration with a bridge input connected across said DC voltage source and with a bridge output connected across said L-C resonant circuit, said L-C circuit comprising resonant inductor means and resonant capacitor means connected in series between said bridge output, said inverter further including an output transformer with a primary winding and a secondary winding, said primary winding connected across said resonant capacitor means in series relation to said resonant inductor means to define said inverter output across said primary winding, said resonant capacitor means composed of a series connected pair of first and second capacitors which define said first and second impedance elements, respectively.

12. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance elements defining therebetween a second connection point, said first and second connection points being connected to each other in order to limit the output voltage of said inverter below a predetermined level, wherein said L-C resonant circuit is a series L-C resonant circuit composed of resonant inductor means and resonant capacitor means, and wherein said inverter includes an additional parallel L-C resonant circuit which is composed of an auxiliary inductor and an auxiliary capacitor and which is connected in series with said switching element across said DC voltage source, while said series L-C resonant circuit is connected across one of said parallel L-C resonant circuit and said switching element.

13. A power supply as set forth in claim 12, wherein said inverter includes an output transformer with a primary winding and a secondary winding, said primary winding connected in parallel with said resonant capacitor means and in series with said resonant inductor means so as to define thereacross said inverter output which is coupled through said secondary winding to said load, and wherein said first and second impedance elements are in the form of first and second capacitors, respectively, which are connected in series across said primary winding.

14. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and by cooperative with said L-C resonant circuit for producing at said inverter output said high frequency AC which is applied to drive a load coupled to said inverter output, said L-C resonant circuit comprising resonant inductor means and resonant capacitor means;

first and second clamping diodes connected in series across said DC voltage in anti-parallel relation thereto, said first and second diodes defining therebetween a first connection point;

first and second impedance elements connected in series across said resonant inductor means to provide a divided voltage indicative of an output voltage produced at said inverter output Under a no-load condition, said first and second impedance elements defining therebetween a second connection point, and said first and second connection points being connected to each other in order to limit the output voltage of said inverter under the no-load condition below a predetermined level.

15. A power supply as set forth in claim 14, wherein said first and second impedance elements are in the form of first and second capacitors, respectively, which are connected in series across said resonant inductor means.

16. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output, said L-C resonant circuit comprising resonant inductor means and resonant capacitor means;

first and second clamping diodes connected in series across said DC voltage in anti-parallel relation thereto, said first and second diodes defining therebetween a first connection point;

first and second impedance elements connected in series across said resonant inductor means to provide a divided voltage indicative of an output voltage produced at said inverter output, said first and second impedance elements defining therebetween a second connection point, and said first and second connection points being connected to each other in order to limit the output voltage of said inverter below a predetermined level, wherein said L-C resonant circuit is a series L-C resonant circuit composed of said resonant inductor means and said capacitor means, and wherein said inverter includes an additional parallel L-C resonant circuit which is composed of an auxiliary inductor and an auxiliary capacitor and which is connected in series with said switching element across said DC voltage source, while said series L-C resonant circuit is connected across one of said parallel L-C resonant circuit and said switching element.

17. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance elements defining therebetween a second connection point; and a fault detector which is activated by a current flowing through a line connected between said first and second connection points only when said L-C resonant circuit produces an excessively high voltage, said fault detector including at least one of alarm means indicating the occurrence of said excessive voltage and control means which controls said switching element of said inverter to lower the output voltage of said inverter.

18. A power supply as set forth in claim 17, wherein said fault detector is coupled to said line through a transformer with a primary winding and a secondary winding, said primary winding is inserted in said line to induce across said secondary winding a voltage corresponding to the current flowing through the line, said secondary winding being connected through a rectifier to said fault detector so as to provide a DC voltage for activating said fault detector only when the current flows through said line in response to said excessive voltage developed by said L-C resonant circuit.

19. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diode connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance elements defining therebetween a second connection point, a rectifier providing a rectified DC voltage from an AC voltage source and a chopper providing said DC voltage source from said rectified DC voltage, said chopper including a chopper switching element which is connected in series with an inductor across said rectifier, said chopper switching element being driven by a chopper controller to repetitively turn on and off for providing an interrupted voltage which is smoothed by a smoothing capacitor to develop thereacross a step-up smoothed voltage in addition to a smoothed voltage smoothed thereat of the DC voltage directly supplied from said rectifier, thereby defining said smoothing capacitor as said DC voltage source supplying said fixed DC voltage to said inverter, and a fault detector which is activated by a current flowing through a line connected between said first and second connection points only when said L-C resonant circuit produces an excessively high voltage, said fault detector connected to said chopper controller to cease turning on and off said chopper switching element in response to the occurrence of said excessive voltage, thereby lowering said DC voltage and therefore the inverter output.

20. A power supply as set forth in claim 1 or 14, wherein said load is a discharge lamp with a pair of cathodes and wherein said inverter includes a transformer with a primary winding and a pair of secondary windings, said primary winding is inserted in a line connected between said first and second connection points to induce voltages respectively across said secondary windings only when said L-C resonant circuit produces a excessively high voltage to flow a current through said line, said secondary windings being respectively connected to heat said cathodes by the voltages induced at said secondary windings, respectively.

21. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output;

first and second clamping diodes connected in series across said DC voltage in anti-parallel relation thereto, said first and second diodes defining therebetween a first connection point;

a series connected pair of first and second impedance elements connected in circuit to provide a divided voltage indicative of an output voltage of said inverter, said first and second impedance elements defining therebetween a second connection point, wherein said load is a discharge lamp and the power supply further comprises a timer and a switch inserted in a line connected between said first and second connection points, said timer being connected to open said switch only for a predetermined time interval after a start-up time of preheating cathodes of the discharge lamp, thereby disabling the operation of limiting said output voltage of the inverter below said predetermined level only for said time interval so as to allow an excessive voltage to be applied to ignite said discharge lamp.

22. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output, said L-C resonant circuit comprising resonant inductor means and resonant capacitor means;

first and second clamping diodes connected in series across said DC voltage in anti-parallel relation thereto, said first and second diodes defining therebetween a first connection point;

first and second impedance elements connected in series across said resonant inductor means to provide a divided voltage indicative of an output voltage produced at said inverter output, said first and second impedance elements defining therebetween a second connection point; and a fault detector which is activated by a current flowing through a line connected between said first and second connection points only when said L-C resonant circuit produces an excessively high voltage, said fault detector including at least one of alarm means indicating the occurrence of said excessive voltage and control means which controls said switching element of said inverter to lower the output voltage of said inverter.

23. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output, said L-C resonant circuit comprising resonant inductor means and resonant capacitor means;

first and second clamping diodes connected in series across said DC voltage in anti-parallel relation thereto, said first and second diodes defining therebetween a first connection point;

first and second impedance elements connected in series across said resonant inductor means to provide a divided voltage indicative of an output voltage produced at said inverter output, said first and second impedance elements defining therebetween a second connection point;

a rectifier providing a rectified DC voltage from an AC voltage source and a chopper providing said DC voltage source from said rectified DC voltage, said chopper including a chopper switching element which is connected in series with an inductor across said rectifier, said chopper switching element being driven by a chopper controller to repetitively turn on and off for providing an interrupted voltage which is smoothed by a smoothing capacitor to develop thereacross a step-up smoothed voltage in addition to a smoothed voltage smoothed thereat of the DC voltage directly supplied from said rectifier, thereby defining said smoothing capacitor as said DC voltage source supplying said fixed DC voltage to said inverter; and a fault detector which is activated by a current flowing through a line connected between said first and second connection points only when said L-C resonant circuit produces an excessively high voltage, said fault detector connected to said chopper controller to cease turning on and off said chopper switching element in response to the occurrence of said excessive voltage, thereby lowering said DC voltage and therefore the inverter output.

24. A power supply comprising:

a fixed DC voltage source;

an inverter energized by said DC voltage to provide a high frequency AC voltage at an inverter output of said inverter, said inverter including at least one switching element and an L-C resonant circuit, said switching element being driven to turn on and off and being cooperative with said L-C resonant circuit for producing at said inverter output said high frequency AC which is applied to drive a load coupled to said inverter output, said L-C resonant circuit comprising resonant inductor means and resonant capacitor means;

first and second clamping diodes connected in series across said DC voltage in anti-parallel relation thereto, said first and second diodes defining therebetween a first connection point;

first and second impedance elements connected in series across said resonant inductor means to provide a divided voltage indicative of an output voltage produced at said inverter output, said first and second impedance elements defining therebetween a second connection point; and wherein said load is a discharge lamp and the power supply further comprises a timer and a switch inserted in a line connected between said first and second connection points, said timer being connected to open said switch only for a predetermined time interval after a start-up time of preheating cathodes of the discharge lamp, thereby disabling the operation of limiting said output voltage of the inverter below said predetermined level only for said time interval so as to allow an excessive voltage to be applied to ignite said discharge lamp.

* * * * *

UNITED STATES PATENT AND TRADEMARK OFFICE

CERTIFICATE OF CORRECTION

PATENT NO. : 5,449,979

DATED : September 12, 1995

INVENTOR(S) : Atsushi UEOKA, et al.

It is certified that error appears in the above-indentified patent and that said Letters Patent is hereby corrected as shown below:

ABSTRACT, line 1, change "avoiding" to --preventing--.

Column 1, line 62, delete "is".

Column 2, line 3, after "flow" insert --into--.

Column 3, line 16, change "avoiding" to --preventing--.

Column 4, line 32, change"occurrent" to --current--.

Column 4, line 41, change "an" to --a--.

Column 5, line 15, after "lighting" insert --of--.

Column 5, line 18, change "to start" to --the start of--.

Column 5, line 20, change "more" to --further--.

Column 5, line 22, change "includes" to --include--.

Column 5, line 33, change "to start" to --the start of--.

Column 5, line 34, delete "assuring to" and change "avoid" to --avoiding--.

UNITED STATES PATENT AND TRADEMARK OFFICE

CERTIFICATE OF CORRECTION

PATENT NO. : 5,449,979

DATED : September 12, 1995

INVENTOR(S) : Atsushi UEOKA, et al.

It is certified that error appears in the above-indentified patent and that said Letters Patent is hereby corrected as shown below:

Column 5, line 35, change "more" to --further--.

Column 5, line 50, change "diagram" to --diagrams--.

Column 6, line 1, change "diagram" to --diagrams--.

Column 6, line 45, change "defines" to --define--.

Column 6, line 50, change "defines" to --define--.

Column 7, line 38, delete "after".

Column 7, line 43, change "operates" to --operate--.

Column 9, line 9, delete "flows".

Column 10, line 14, change "inductors" to --inductor--.

Column 12, line 25, delete "a" before "capacitor" and change "capacitor" to --capacitors--.

Column 13, line 53, change "upon" to --when--.

Column 14, line 22, change "give" to --gives--.

Column 14, line 39, delete "resistor" at end of line.

UNITED STATES PATENT AND TRADEMARK OFFICE

CERTIFICATE OF CORRECTION

PATENT NO. : 5,449,979

DATED : September 12, 1995

INVENTOR(S) : Atsushi UEOKA, et al.

It is certified that error appears in the above-indentified patent and that said Letters Patent is hereby corrected as shown below:

Column 15, line 53, change "for" to --to--.

Column 15, line 54, change "derived" to --derives--.

Column 17, line 18, change "gathered" to --combined--.

Column 21, line 37, change "by" to --being--.

Column 21, line 50, change "Under" to --under--.

Signed and Sealed this

Thirteenth Day of February, 1996

*Attest:*

Bruce Lehman

BRUCE LEHMAN

*Attesting Officer*

*Commissioner of Patents and Trademarks*